US011089415B1

(12) United States Patent
Lesso

(10) Patent No.: US 11,089,415 B1
(45) Date of Patent: Aug. 10, 2021

(54) ON-EAR TRANSITION DETECTION

(71) Applicant: Cirrus Logic International Semiconductor Ltd., Edinburgh (GB)

(72) Inventor: John P. Lesso, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/829,600

(22) Filed: Mar. 25, 2020

(51) Int. Cl.
*H04R 29/00* (2006.01)

(52) U.S. Cl.
CPC ..... *H04R 29/001* (2013.01); *H04R 2400/01* (2013.01); *H04R 2460/03* (2013.01)

(58) Field of Classification Search
CPC ..... H04R 29/001; H04R 2400/01; H04R 2460/03; H04R 1/1041
See application file for complete search history.

(56) References Cited

U.S. PATENT DOCUMENTS

| | | | | |
|---|---|---|---|---|
| 6,697,299 | B2 | 2/2004 | Kato et al. | |
| 10,506,336 | B1 | 12/2019 | Lesso | |
| 2004/0196992 | A1* | 10/2004 | Ryan | H04R 29/001 381/312 |
| 2005/0013447 | A1* | 1/2005 | Crump | H02M 3/156 381/71.6 |
| 2015/0281825 | A1* | 10/2015 | Johnson | H04R 5/033 381/74 |
| 2016/0150335 | A1* | 5/2016 | Qutub | H04R 1/1041 381/59 |
| 2017/0105063 | A1* | 4/2017 | Huang | H04R 29/001 |
| 2019/0294769 | A1 | 9/2019 | Lesso | |
| 2019/0335263 | A1 | 10/2019 | Wurtz et al. | |

FOREIGN PATENT DOCUMENTS

| | | | |
|---|---|---|---|
| EP | 1465454 | A2 | 10/2004 |
| WO | 2020021234 | A1 | 1/2020 |

OTHER PUBLICATIONS

International Search Report and Written Opinion of the International Searching Authority, International Application No. PCT/GB2021/050715, dated Jun. 16, 2021.

* cited by examiner

*Primary Examiner* — Jason R Kurr
(74) *Attorney, Agent, or Firm* — Jackson Walker L.L.P.

(57) ABSTRACT

The disclosure relates in general to on-ear transition detection, and in particular to on-ear transition detection circuitry comprising: a monitoring unit operable to monitor a speaker current flowing through a speaker and/or a speaker voltage induced across the speaker, and to generate a monitor signal indicative of the speaker current and/or the speaker voltage; and an event detector operable to detect a qualifying disturbance in a sensor signal indicative of a qualifying pressure change incident on the speaker caused by the speaker transitioning from an on-ear state to an off-ear state or vice versa, wherein the sensor signal is, or is derived from, the monitor signal.

19 Claims, 26 Drawing Sheets

ON-EAR TRANSITION DETECTION

FIELD OF DISCLOSURE

The present disclosure relates in general to on-ear transition detection, and in particular to on-ear transition detection circuitry (such as audio circuitry) having, or being configured for operation with, a transducer such as a speaker or loudspeaker.

In particular, the present disclosure relates to circuitry for use in a host device having a speaker or loudspeaker, such as a headphone or set of headphones. An in-ear headphone is an example host device which is focussed on herein.

Such circuitry may be configured to detect a transition of a host device from a deployed or "on-ear" state (e.g. inserted or plugged into a user's ear canal, or in the vicinity of the user's ear) to a non-deployed or "off-ear" state (e.g. removed from a user's ear canal, or from the vicinity of the user's ear), or vice versa.

The present disclosure extends to such host devices comprising the on-ear transition detection circuitry (e.g. audio circuitry) and to corresponding methods.

BACKGROUND

Taking audio circuitry as a convenient example, such circuitry may be implemented (at least partly on ICs) within a host device, which may be considered an electrical or electronic device and may be a mobile device. Examples devices include a portable and/or battery powered host device such as a mobile telephone, an audio player, a video player, a PDA, a mobile computing platform such as a laptop computer or tablet and/or a games device. An example host device of particular relevance to the present disclosure is a headphone such as an in-ear headphone. An in-ear headphone is sometimes referred to as an in-ear transducer or an "earbud".

Headphones traditionally refer to a pair of small loudspeakers worn on or around the head, for example fitting around or over a user's ears, and which may use a band over the top of the head to hold the speakers in place. Earbuds or earpieces are in-ear headphones which consist of individual units that plug into the user's ear canal. As with traditional headphones, in some arrangements a pair of in-ear headphones may be provided physically connected together via an interconnecting band. In other arrangements, a pair of in-ear headphones may be provided as separate units, not physically connected together.

Battery life in host devices is often a key design constraint, and this can be exacerbated in "small" host devices such as headphones. Accordingly, host devices are typically capable of being placed into a lower-power state or "sleep mode." In this low-power state, generally only minimal circuitry is active, such minimal circuitry including components necessary to sense a stimulus for activating higher-power modes of operation.

In order to reduce power consumption, many personal audio devices (host devices) have a dedicated "in-ear detect" (or "on-ear detect") function, operable to detect the presence or absence of an ear in proximity to the device. If no ear is detected, the device may be placed in a low-power state in order to conserve power; if an ear is detected, the device may be placed in a relatively high-power state.

In-ear (on-ear) detect functions may also be used for other purposes. For example, a mobile phone may utilize an in-ear detect function to lock a touchscreen when the phone is placed close to the user's ear, in order to prevent inadvertent touch input while on a call. For example, a personal audio device may pause audio playback responsive to detection of the personal audio device being removed from the user's ears, or un-pause audio upon detection of the personal audio device being applied to the user's ears. In-ear detect functions may thus be considered to encompass on-ear detect functions and/or ear-proximity detect functions.

Taking in-ear headphones as a running example, it is known to use optical sensors to determine if the in-ear headphone is in a deployed or on-ear state (e.g. inserted or plugged into a user's ear canal) or in a non-deployed or off-ear state (removed from a user's ear canal), since this may determine whether the in-ear headphone is placed in a lower-power state or "sleep mode", or in a high-power state or "active mode" or "woken mode". It is also known to use a combination of a speaker and separate microphone provided in an in-ear headphone to determine an acoustic transfer function of the environment around the in-ear headphone in order to determine if the in-ear headphone is in the deployed state or in the non-deployed state.

However, such systems are considered to be open to improvement when power performance is taken into account.

It is desirable to provide improved audio circuitry and related host devices, for example in which power performance reaches acceptable levels.

SUMMARY

According to a first aspect of the present disclosure, there is provided on-ear transition detection circuitry, comprising: a monitoring unit operable to monitor a speaker current flowing through a speaker and/or a speaker voltage induced across the speaker, and to generate a monitor signal indicative of the speaker current and/or the speaker voltage;

and an event detector operable to detect a qualifying disturbance in a sensor signal indicative of a qualifying pressure change incident on the speaker caused by the speaker transitioning from an on-ear state to an off-ear state or vice versa, wherein the sensor signal is, or is derived from, the monitor signal.

According to a second aspect of the present disclosure, there is provided audio circuitry, comprising: a monitoring unit operable to monitor a speaker current flowing through a speaker and/or a speaker voltage induced across the speaker, and to generate a monitor signal indicative of the speaker current and/or the speaker voltage; and an event detector operable to detect a qualifying disturbance in a sensor signal indicative of a qualifying pressure change incident on the speaker, wherein the sensor signal is, or is derived from, the monitor signal.

According to a third aspect of the present disclosure, there is provided transducer circuitry, comprising: a monitoring unit operable to monitor a transducer current flowing through a transducer and/or a transducer voltage induced across the transducer, and to generate a monitor signal indicative of the transducer current and/or the transducer voltage; and an event detector operable to detect a qualifying disturbance in a sensor signal indicative of a qualifying pressure change incident on the transducer, wherein the sensor signal is, or is derived from, the monitor signal.

According to a fourth aspect of the present disclosure, there is provided a method of detecting a qualifying pressure change incident on a speaker, the method comprising: generating a monitor signal indicative of a speaker current flowing through the speaker and/or a speaker voltage induced across the speaker; and detecting a qualifying disturbance in a sensor signal indicative of a qualifying pressure change incident on the speaker, wherein the sensor signal is, or is derived from, the monitor signal.

According to a fifth aspect of the present disclosure, there is provided a method of detecting the insertion into or removal from an ear canal of an in-ear headphone, the in-ear headphone comprising a speaker, the method comprising: generating a monitor signal indicative of a speaker current flowing through the speaker and/or a speaker voltage induced across the speaker; and detecting a qualifying disturbance in a sensor signal indicative of a qualifying pressure change incident on the speaker, wherein the sensor signal is, or is derived from, the monitor signal, and wherein the qualifying pressure change corresponds to the insertion into or removal from the ear canal of the in-ear headphone.

According to a sixth aspect of the present disclosure, there is provided a method of detecting the insertion into or removal from an ear canal of an in-ear headphone, the in-ear headphone comprising a speaker, the method comprising: generating a monitor signal indicative of a speaker current flowing through the speaker and/or a speaker voltage induced across the speaker; and detecting a disturbance in a sensor signal indicative of the insertion into or removal from the ear canal of the in-ear headphone, wherein the sensor signal is, or is derived from, the monitor signal.

According to a seventh aspect of the present disclosure, there is provided a method of detecting a transition of a speaker from an on-ear state to an off-ear state or vice versa, the method comprising: generating a monitor signal indicative of a speaker current flowing through the speaker and/or a speaker voltage induced across the speaker; and detecting a disturbance in a sensor signal indicative of the transitioning, wherein the sensor signal is, or is derived from, the monitor signal.

A further aspect provides an electronic apparatus or host device comprising processing circuitry and a non-transitory machine-readable medium storing instructions which, when executed by the processing circuitry, cause the electronic apparatus to implement a method as recited above.

Another aspect provides a non-transitory machine-readable medium storing instructions which, when executed by processing circuitry, cause an electronic apparatus or host device to implement a method as recited above.

Another aspect provides instructions (e.g. a computer program) which, when executed by processing circuitry (e.g. a processor), cause an electronic apparatus or host device to implement a method as recited above.

BRIEF DESCRIPTION OF THE DRAWINGS

Reference will now be made, by way of example only, to the accompanying drawings, of which.

DETAILED DESCRIPTION

Embodiments of the present disclosure provide apparatus (e.g. host devices, or circuits), systems, methods and computer programs for the detection of deployment-state transitions of host devices.

In particular, embodiments utilize a pressure-change monitoring process to detect a transition of a host device from a deployed or "on-ear" state (e.g. inserted or plugged into a user's ear canal, or in the vicinity of the user's ear) to a non-deployed or "off-ear" state (e.g. removed from a user's ear canal, or from the vicinity of the user's ear), or vice versa. Such embodiments take advantage of pressure changes experienced in such transitions (referred to herein as "qualifying pressure changes"), and seek to identify those pressure changes as incident on a transducer such as a loudspeaker.

A useful example to keep in mind is that when an in-ear headphone is inserted into a user's ear canal (non-deployed to deployed state) its loudspeaker is likely to experience a step change increase in the steady state external pressure it experiences. The transition from a non-deployed to deployed state may be referred to herein as an insertion event. Similarly, when an in-ear headphone is removed from a user's ear canal (deployed to non-deployed state) its loudspeaker is likely to experience a step change decrease in the steady state external pressure it experiences. The transition from a deployed to non-deployed state may be referred to herein as an insertion event. Similar pressure changes may be experienced at loudspeakers of other host devices such as other types of headphones or mobile phones during similar transitions, which will also be referred to as insertion and removal events for simplicity.

Some embodiments (also) use a biometric process, based on one or more ear biometric features, to detect the presence or absence of the ear.

As used herein, the term "host device" is any electrical or electronic device which is suitable for or configurable to analyse a pressure change incident on a transducer such as a speaker or loudspeaker. Particular examples are suitable for providing audio playback substantially to only a single user, and may be referred to as a personal audio device. Corresponding transducer-analysing circuitry or audio circuitry may be provided as part of such a host device.

Some examples of suitable host devices are shown in FIGS. 1*a* to 1*e*.

Figure 1A:
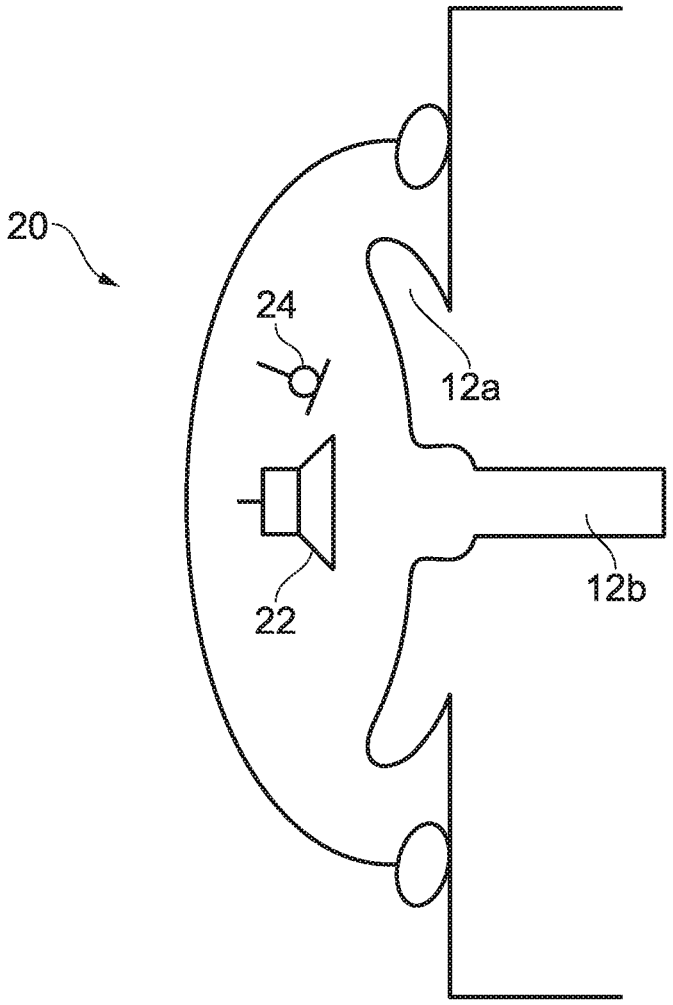
FIGS. 1*a* to 1*e* show examples of host devices, which may be considered personal audio devices.

FIG. 1*a* shows a schematic diagram of a user's ear, comprising the (external) pinna or auricle 12*a*, and the (internal) ear canal 12*b*. A host device 20 comprising a circum-aural headphone is worn by the user over the ear, and is shown in an "on-ear" state. The headphone comprises a shell which substantially surrounds and encloses the auricle 12*a*, so as to provide a physical barrier between the user's ear and the external environment. Cushioning or padding may be provided at an edge of the shell, so as to increase the comfort of the user, and also the acoustic coupling between the headphone and the user's skin (i.e. to provide a more effective barrier between the external environment and the user's ear).

The headphone comprises one or more loudspeakers 22 positioned on an internal surface of the headphone, and arranged to generate acoustic signals towards the user's ear and particularly the ear canal 12*b*. The headphone further comprises one or more (optional) microphones 24, also positioned on the internal surface of the headphone, arranged to detect acoustic signals within the internal volume defined by the headphone, the auricle 12*a* and the ear canal 12*b*. In some arrangements the one or more microphones 24 need not be provided.

Figure 1B:
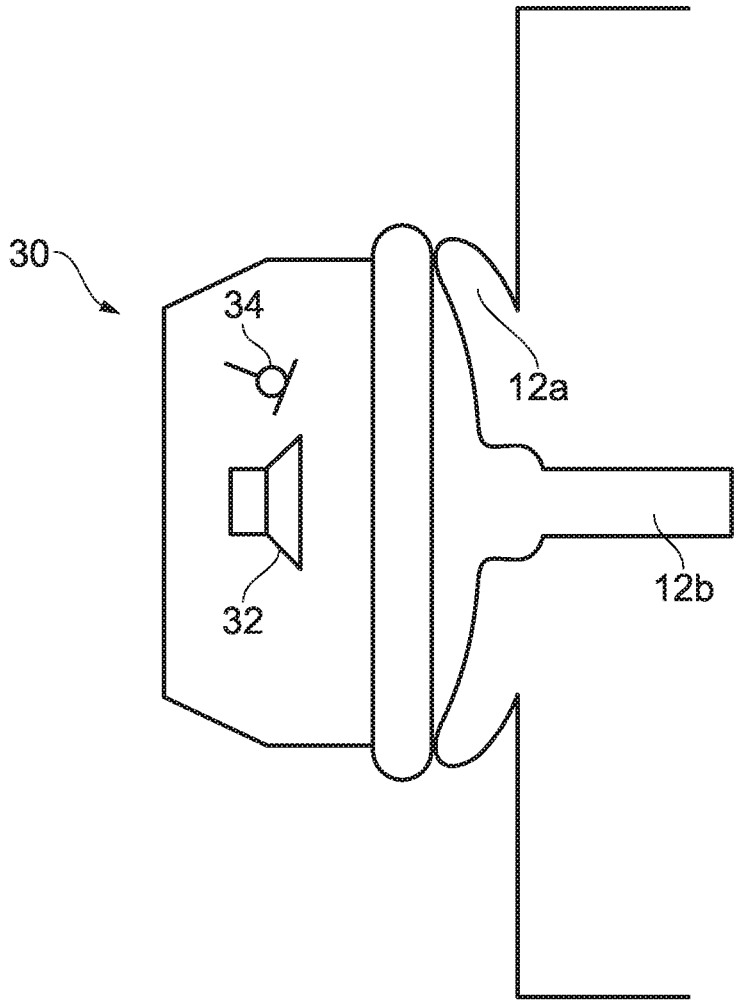

FIG. 1*b* shows an alternative host device 30, comprising a supra-aural headphone. The supra-aural headphone does not surround or enclose the user's ear, but rather sits on the auricle 12*a*, and is shown in an "on-ear" state. The headphone may comprise a cushion or padding to lessen the impact of environmental noise. As with the circum-aural headphone shown in FIG. 1*a*, the supra-aural headphone comprises one or more loudspeakers 32 and one or more optional microphones 34.

Figure 1C:
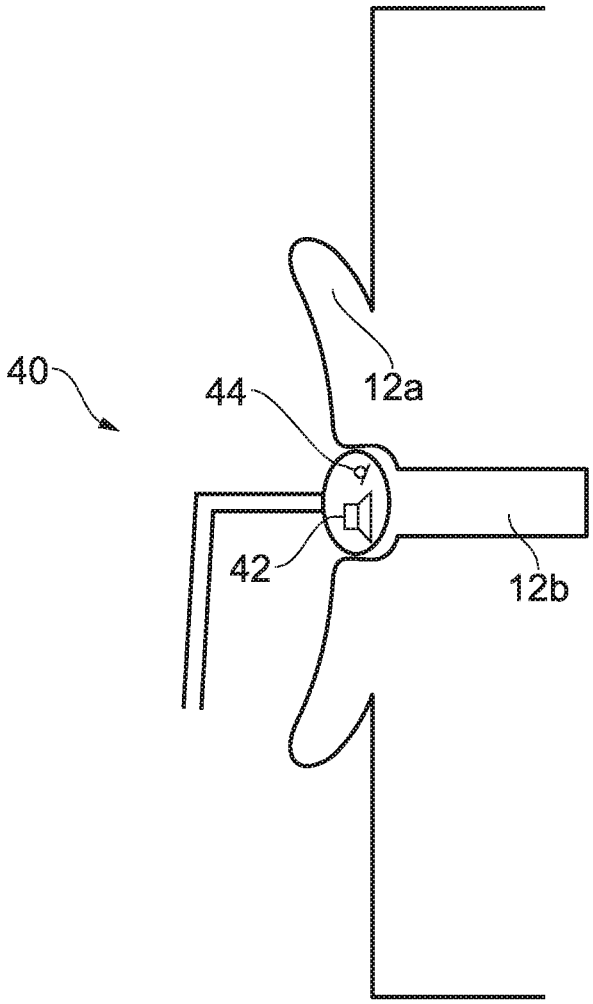

FIG. 1*c* shows a further alternative host device 40, comprising an intra-concha headphone (or earphone). In use, the intra-concha headphone sits inside the user's concha cavity, and is shown in an "on-ear" state. The intra-concha headphone may fit loosely within the cavity, allowing the flow of air into and out of the user's ear canal 12*b*.

As with the devices shown in FIGS. 1*a* and 1*b*, the intra-concha headphone comprises one or more loudspeakers 42 and one or more optional microphones 44.

Figure 1D:
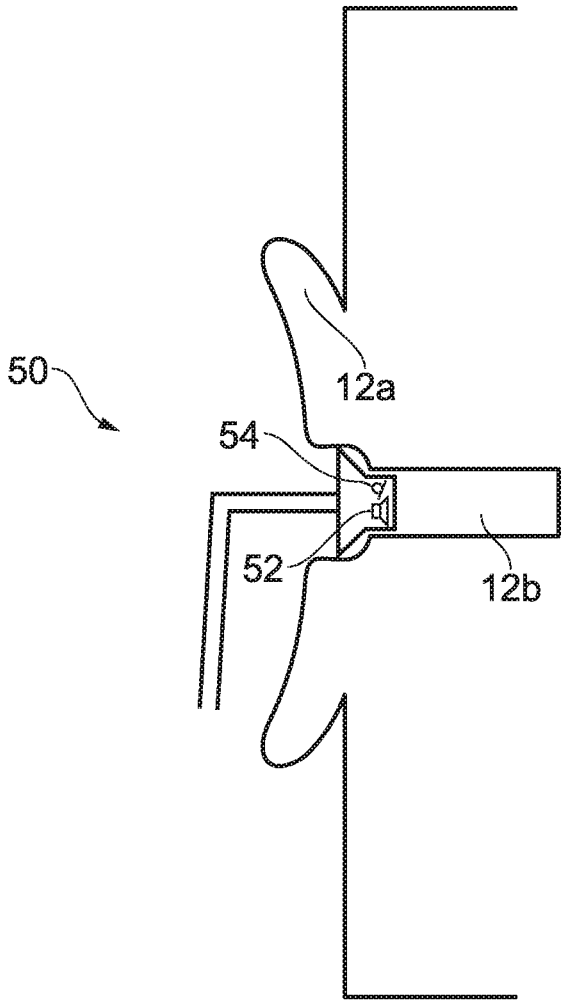

FIG. 1*d* shows a further alternative host device 50, comprising an in-ear headphone (or earphone), insert headphone, or ear bud, and is shown in an "on-ear" state. This headphone is configured to be partially or totally inserted within the ear canal 12*b*, and may provide a relatively tight seal between the ear canal 12*b* and the external environment (i.e. it may be acoustically closed or sealed). The headphone may comprise one or more loudspeakers 52 and one or more optional microphones 54, as with the others devices described above.

As the in-ear headphone may provide a relatively tight acoustic seal around the ear canal 12*b*, external noise (i.e. coming from the environment outside) detected by the microphone 54 is likely to be low. However, the pressure changes associated with the deployed/non-deployed state transitions are likely to be relatively large.

Figure 1E:
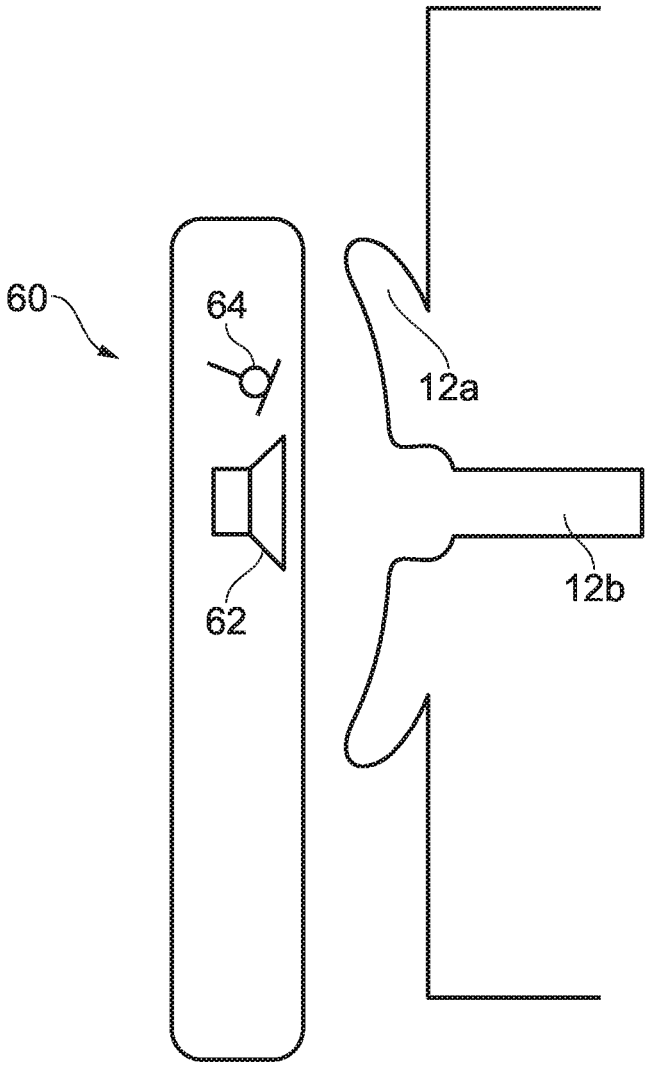

FIG. 1*e* shows a further alternative host device 60, which is a mobile or cellular phone or handset, and is shown in an "on-ear" state. The handset 60 comprises one or more loudspeakers 62 for audio playback to the user, and one or more optional microphones 64 which are similarly positioned.

In use, the handset 60 is held close to the user's ear (as shown, being the "on-ear" state) so as to provide audio playback (e.g. during a call). While a tight acoustic seal is not achieved between the handset 60 and the user's ear, the handset 60 is typically held close enough that an acoustic stimulus applied to the ear via the one or more loudspeakers 62 generates a response from the ear which can be detected by the one or more microphones 64. There may also be a detectable pressure change associated with the deployed/non-deployed state transitions.

All of the host devices described in connection with FIGS. 1*a* to 1*e* may provide audio playback to substantially a single user in use. Each device comprises one or more loudspeakers and optionally one or more microphones, which may be utilized to generate biometric data related to the user's ear for example as described in US 2019/0294769 A1, the entire contents of which are incorporated herein by reference.

All of the host devices described in connection with FIGS. 1*a* to 1*e* may be able to perform active noise cancellation, to reduce the amount of noise experienced by the user of the headphone. Active noise cancellation operates by detecting a noise (i.e. with a microphone), and generating a signal (i.e. with a loudspeaker) that has the same amplitude as the noise signal but is opposite in phase.

Figure 2:
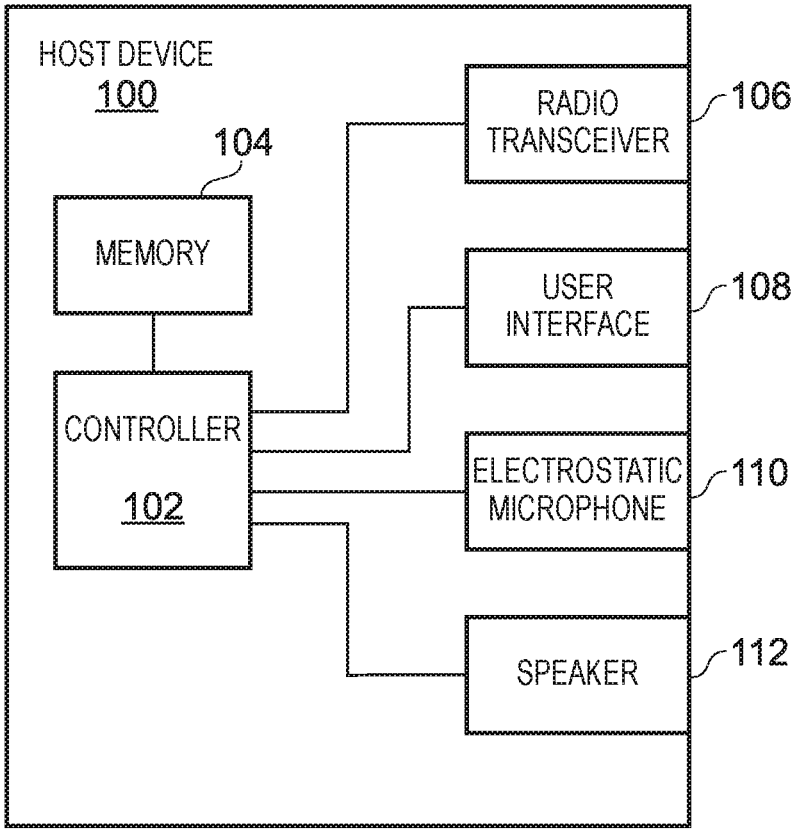
FIG. 2 is a schematic diagram of a host device.

FIG. 2 is a schematic diagram of a host device 100, which may be considered an electrical or electronic device and may be a mobile device. Host device 100 may be considered representative of any of the devices shown in FIGS. 1*a* to 1*e*, any of which may be used to implement aspects of the present disclosure.

Host device 100 comprises audio circuitry 200 (not specifically shown) as will be explained in more detail in connection with FIG. 2. The audio circuitry 200 may be considered an example of on-ear transition detection circuitry. Although host device 100 is shown schematically, it will be assumed that it may be a headphone and indeed an example arrangement in which the host device 100 is an in-ear headphone will be taken forward as a running example.

As shown in FIG. 1, host device 100 comprises a controller 102, a memory 104, a radio transceiver 106, a user interface 108, at least one microphone 110, and at least one speaker unit 112. In some arrangements, the user interface 108 and microphone 110 may be omitted. In some arrangements, the radio transceiver 106 may be omitted. In some arrangements the speaker unit 112 may be replaced with another transducer and the audio circuitry 200 referred to as transducer circuitry. Examples of transducers that could detect a pressure differential could be any capacitive-based transducer or coil-based transducer, e.g. an accelerometer. In view of the detection (as explained in more detail later) of a transition of the host device 100 from a deployed (on-ear) state to a non-deployed (off-ear) state, or vice versa, the audio circuitry 200 may be referred to as on-ear transition detection circuitry.

The speaker unit 112 may correspond to any of the loudspeakers 22, 32, 42, 52, 62. Similarly, the microphone 110 may correspond to any of the microphones 24, 34, 44, 54, 64.

The host device may comprise an enclosure, i.e. any suitable housing, casing, or other enclosure for housing the various components of host device 100. The enclosure may be constructed from plastic, metal, and/or any other suitable materials. In addition, the enclosure may be adapted (e.g., sized and shaped) such that host device 100 is readily transported by a user of host device 100.

In the case of an in-ear headphone as in the running example, the enclosure may be adapted (e.g., sized and shaped) to be plugged into the ear canal of a user. It will be understood that discussion herein of an in-ear headphone being "plugged into" the ear canal of a user (deployed state) may correspond to the in-ear headphone being plugged or slotted or inserted at least partially or fully into the ear canal, depending on the arrangement. For completeness, in the case of another type of host device 100 such as a mobile telephone such as a smart phone, an audio player, a video player, a PDA, a mobile computing platform such as a laptop computer or tablet computing device, a handheld computing device, or a games device, the enclosure may be suitably adapted for ergonomic use, and the deployed state may be for example being in proximity to a user's ear or against a user's ear (see FIGS. 1*a* to 1*e* for examples). As before, the deployed state corresponds to the "on-ear" state and the non-deployed state corresponds to an "off-ear" state.

Controller 102 is housed within the enclosure and includes any system, device, or apparatus configured to interpret and/or execute program instructions and/or process data, and may include, without limitation a microprocessor, microcontroller, digital signal processor (DSP), application specific integrated circuit (ASIC), or any other digital or analogue circuitry configured to interpret and/or execute program instructions and/or process data. In some arrangements, controller 102 interprets and/or executes program instructions and/or processes data stored in memory 104 and/or other computer-readable media accessible to controller 102.

Memory 104 may be housed within the enclosure, may be communicatively coupled to controller 102, and includes any system, device, or apparatus configured to retain program instructions and/or data for a period of time (e.g., computer-readable media). Memory 104 may include random access memory (RAM), electrically erasable programmable read-only memory (EEPROM), a Personal Computer Memory Card International Association (PCMCIA) card, flash memory, magnetic storage, opto-magnetic storage, or any suitable selection and/or array of volatile or non-volatile memory that retains data after power to host device 100 is turned off.

User interface 108 may be housed at least partially within the enclosure, may be communicatively coupled to the controller 102, and comprises any instrumentality or aggregation of instrumentalities by which a user may interact with user host device 100. For example, user interface 108 may permit a user to input data and/or instructions into user host device 100 (e.g., via a button, keypad and/or touch screen), and/or otherwise manipulate host device 100 and its associated components. User interface 108 may also permit host device 100 to communicate data to a user, e.g., by way of a display device (e.g. touch screen or LED).

Capacitive microphone 110 may be housed at least partially within enclosure 101, may be communicatively coupled to controller 102, and comprise any system, device, or apparatus configured to convert sound incident at microphone 110 to an electrical signal that may be processed by controller 102, wherein such sound is converted to an electrical signal using a diaphragm or membrane having an electrical capacitance that varies as based on sonic vibrations received at the diaphragm or membrane. Capacitive microphone 110 may include an electrostatic microphone, a condenser microphone, an electret microphone, a microelectromechanical systems (MEMs) microphone, or any other suitable capacitive microphone. In some arrangements multiple capacitive microphones 110 may be provided and employed selectively or together. In some arrangements the capacitive microphone 110 may not be provided, the speaker unit 112 being relied upon to serve as a microphone as explained later.

Radio transceiver 106 may be housed within the enclosure, may be communicatively coupled to controller 102, and includes any system, device, or apparatus configured to, with the aid of an antenna, generate and transmit radio-frequency signals as well as receive radio-frequency signals and convert the information carried by such received signals into a form usable by controller 102. Of course, radio transceiver 106 may be replaced with only a transmitter or only a receiver in some arrangements. Radio transceiver 106 may be configured to transmit and/or receive various types of radio-frequency signals, including without limitation, cellular communications (e.g., 2G, 3G, 4G, LTE, etc.), short-range wireless communications (e.g., BLUETOOTH), commercial radio signals, television signals, satellite radio signals (e.g., GPS), Wireless Fidelity, etc.

The speaker unit 112 comprises a speaker (possibly along with supporting circuitry) and may be housed at least partially within the enclosure or may be external to the enclosure (e.g. attachable thereto in the case of headphones). Such a speaker may be referred to as a loudspeaker. As will be explained later, the audio circuitry 200 described in connection with FIG. 3 may be taken to correspond to the speaker unit 112 or to a combination of the speaker unit 112 and the controller 102. It will be appreciated that in some arrangements multiple speaker units 112 may be provided and employed selectively or together. As such the audio circuitry 200 described in connection with FIG. 2 may be taken to be provided multiple times corresponding respectively to the multiple speaker units 112, although it need not be provided for each of those speaker units 112. The present disclosure will be understood accordingly.

The speaker unit 112 may be communicatively coupled to controller 102, and may comprise any system, device, or apparatus configured to produce sound in response to electrical audio signal input. In some arrangements, the speaker unit 112 may comprise as its speaker a dynamic loudspeaker.

A dynamic loudspeaker may be taken to employ a lightweight diaphragm mechanically coupled to a rigid frame via a flexible suspension that constrains a voice coil to move axially through a cylindrical magnetic gap. When an electrical signal is applied to the voice coil, a magnetic field is created by the electric current in the voice coil, making it a variable electromagnet. The coil and the driver's magnetic system interact, generating a mechanical force that causes the coil (and thus, the attached cone) to move back and forth, thereby reproducing sound under the control of the applied electrical signal coming from the amplifier.

In arrangements in which host device 100 includes a plurality of speaker units 112, such speakers unit 112 may serve different functions. For example, in some arrangements, a first speaker unit 112 may play ringtones and/or other alerts while a second speaker unit 112 may play voice data (e.g., voice data received by radio transceiver 106 from another party to a phone call between such party and a user of host device 100).

Although specific example components are depicted above in FIG. 2 as being integral to host device 100 (e.g., controller 102, memory 104, user interface 108, microphone 110, radio transceiver 106, speakers(s) unit 112), in some arrangements the host device 100 may comprise one or more components not specifically enumerated above. In other arrangements the host device 100 may comprise a subset of the components specifically enumerated above, for example it might not comprise the radio transceiver 106 and/or the microphone 110 as mentioned earlier.

As mentioned above, one or more speakers units 112 may be employed as a microphone. For example, sound incident on a cone or other sound producing component of a speaker unit 112 may cause motion in such cone, thus causing motion of the voice coil of such speaker unit 112, which induces a voltage on the voice coil which may be sensed and transmitted to controller 102 and/or other circuitry for processing, effectively operating as a microphone. Sound detected by a speaker unit 112 used as a microphone may be used for many purposes.

For example, in some arrangements a speaker unit 112 may be used as a microphone to sense voice commands and/or other audio stimuli. These may be employed to carry out predefined actions (e.g. predefined voice commands may be used to trigger corresponding predefined actions).

Voice commands and/or other audio stimuli may be employed for "waking up" the host device 100 from a low-power state and transitioning it to a higher-power state. In such arrangements, when host device 100 is in a low-power state, a speaker unit 112 may communicate electronic signals (a microphone signal) to controller 102 for processing. Controller 102 may process such signals and determine if such signals correspond to a voice command and/or other stimulus for transitioning host device 100 to a higher-power state. If controller 102 determines that such signals correspond to a voice command and/or other stimulus for transitioning host device 100 to a higher-power state, controller 102 may activate one or more components of host device 100 that may have been deactivated in the low-power state (e.g., capacitive microphone 110, user interface 108, an applications processor forming part of the controller 102).

In some instances, a speaker unit 112 may be used as a microphone for sound pressure levels or volumes above a certain level, such as the recording of a live concert, for example. In such higher sound levels, a speaker unit 112 may have a more reliable signal response to sound as compared with capacitive microphone 110. When using a speaker unit 112 as a microphone, controller 102 and/or other components of host device 100 may perform frequency equalization, as the frequency response of a speaker unit 112 employed as a microphone may be different than capacitive microphone 110. Such frequency equalization may be accomplished using filters (e.g., a filter bank) as is known in the art. In particular arrangements, such filtering and frequency equalization may be adaptive, with an adaptive filtering algorithm performed by controller 102 during periods of time in which both capacitive microphone 110 is active (but not overloaded by the incident volume of sound) and a speaker unit 112 is used as a microphone. Once the frequency response is equalized, controller 102 may smoothly transition between the signals received from capacitive microphone 110 and speaker unit 112 by cross-fading between the two.

In some instances, a speaker unit 112 may be used as a microphone to enable identification of a user of the host device 100. For example, a speaker unit 112 (e.g. implemented as a headphone, earpiece or earbud) may be used as a microphone while a speaker signal is supplied to the speaker (e.g. to play sound such as music) or based on noise. In that case, the microphone signal may contain information about the ear canal of the user, enabling the user to be identified by analysing the microphone signal. For example, the microphone signal may indicate how the played sound or noise resonates in the ear canal, which may be specific to the ear canal concerned. Since the shape and size of each person's ear canal is unique, the resulting data could be used to distinguish a particular (e.g. "authorised") user from other users. Accordingly, the host device 100 (including the speaker unit 112) may be configured in this way to perform a biometric check, similar to a fingerprint sensor or eye scanner.

It will be apparent that in some arrangements, a speaker unit 112 may be used as a microphone in those instances in which it is not otherwise being employed to emit sound. For example, when host device 100 is in a low-power state, a speaker unit 112 may not emit sound and thus may be employed as a microphone (e.g., to assist in waking host device 100 from the low-power state in response to voice activation commands, as described above). As another example, when host device 100 is in a speakerphone mode, a speaker unit 112 typically used for playing voice data to a user when host device 100 is not in a speakerphone mode (e.g., a speaker unit 112 the user typically holds to his or her ear during a telephonic conversation) may be deactivated from emitting sound and in such instance may be employed as a microphone.

However, in other arrangements (for example, in the case of the biometric check described above), a speaker unit 112 may be used simultaneously as a speaker and a microphone, such that a speaker unit 112 may simultaneously emit sound while capturing sound. In such arrangements, a cone and voice coil of a speaker unit 112 may vibrate both in response to a voltage signal applied to the voice coil and other sound incident upon speaker unit 112. As will become apparent from FIG. 2, the controller 102 and or the speaker unit 112 may determine a current flowing through the voice coil, which will exhibit the effects of: a voltage signal used to drive the speaker (e.g., based on a signal from the controller 102); and a voltage induced by external sound incident on the speaker unit 112. It will become apparent from FIG. 2 how the audio circuitry 200 enables a microphone signal (attributable to the external sound incident on the speaker of the speaker unit 112) to be recovered in this case.

In these and other arrangements, host device 100 may include at least two speaker units 112 which may be selectively used to transmit sound or as a microphone. In such arrangements, each speaker unit 112 may be optimized for performance at a particular volume level range and/or frequency range, and controller 102 may select which speaker unit(s) 112 to use for transmission of sound and which speaker unit(s) 112 to use for reception of sound based on detected volume level and/or frequency range.

It will appreciated that such the detection of voice commands or ear biometrics may form a secondary part of detecting whether the host device should be "woken up" from a low-power state, or conversely entered into a "sleep mode", as mentioned later herein. Embodiments may initially (or even only) utilize a pressure-change monitoring process to detect a transition of the host device 100 from a deployed state to a non-deployed state, or vice versa, to detect whether the host device should be "woken up" from a low-power state, or conversely entered into a "sleep mode".

Thus, focus will now be placed on how the speaker unit 112 may be used to gather information about the surroundings of the host device 100, effectively using the speaker unit 112 (in particular, a speaker of the speaker unit 112) as a sensor to detect a transition of the host device 100 from a deployed (on-ear) state to a non-deployed (off-ear) state, or vice versa. In some arrangements, such a sensor may be referred to as a pressure sensor or even a microphone. It will later become apparent how such sensor may be usefully employed particularly in the context of a host device 100 such as an in-ear headphone as in the running example.

Figure 3:
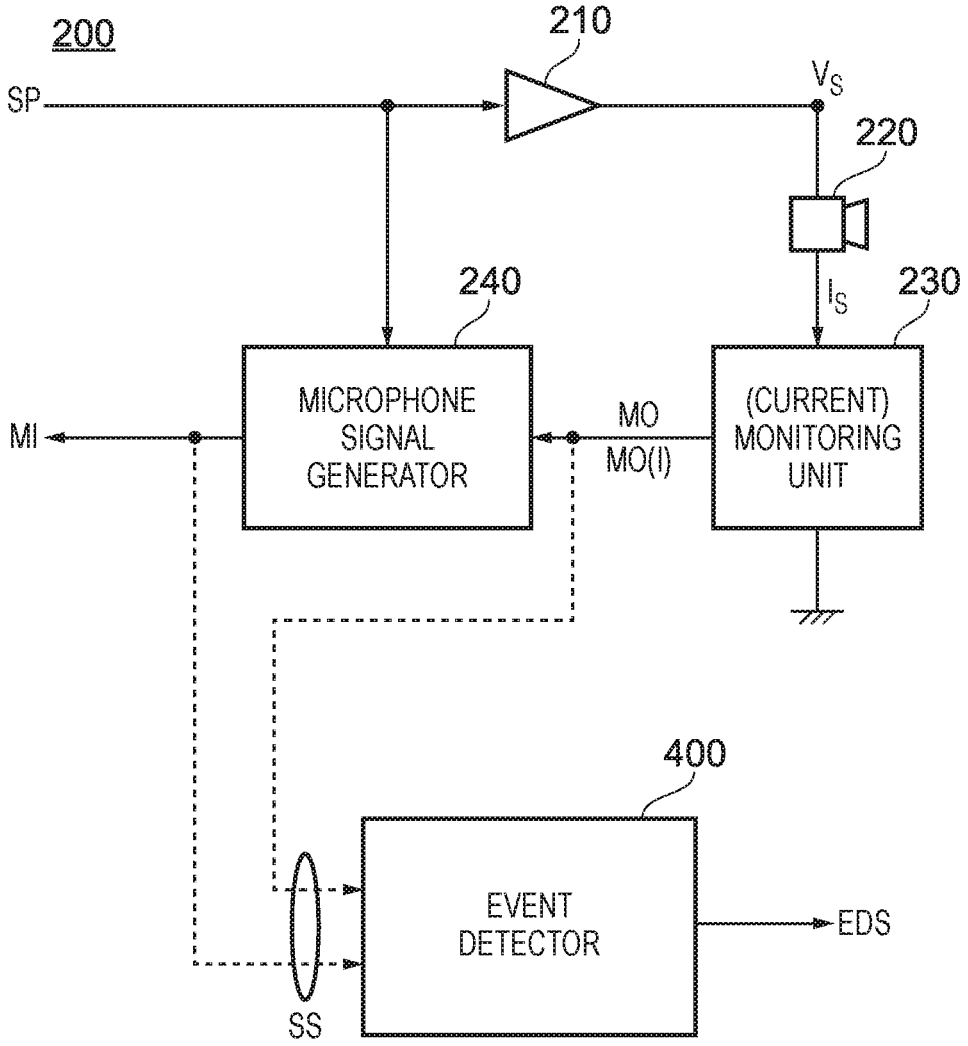
FIG. 3 is a schematic diagram of audio circuitry for use in the FIG. 1 host device.

FIG. 3 is a schematic diagram of the audio circuitry (on-ear transition detection circuitry) 200. The audio circuitry comprises a speaker driver 210, a speaker 220, a current monitoring unit (or simply, monitoring unit) 230, a microphone signal generator 240, and an event detector 400.

For ease of explanation the audio circuitry 200 (including the speaker 220) will be considered hereinafter to correspond to the speaker unit 112 of FIG. 2, with the signals SP and MI in FIG. 3 (described later) effectively being communicated between the audio circuitry 200 and the controller 102. As before, the speaker 220 is an example transducer.

The speaker driver 210 is configured, based on a speaker signal SP, to drive the speaker 220, in particular to drive a given speaker voltage signal $V_S$ on a signal line to which the speaker 220 is connected. The speaker 220 is connected between the signal line and ground, with the current monitoring unit 230 connected such that a speaker current $I_S$ flowing through the speaker 220 is monitored by the current monitoring unit 230.

Of course, this arrangement is one example, and in another arrangement the speaker 220 could be connected between the signal line and supply, again with the current monitoring unit 230 connected such that a speaker current $I_S$ flowing through the speaker 220 is monitored by the current monitoring unit 230. In yet another arrangement, the speaker driver 210 could be an H-bridge speaker driver with the speaker 220 then connected to be driven, e.g. in antiphase, at both ends. Again, the current monitoring unit 230 would be connected such that a speaker current $I_S$ flowing through the speaker 220 is monitored by the current monitoring unit 230. The present disclosure will be understood accordingly.

Returning to FIG. 2, the speaker driver 210 may be an amplifier such as a power amplifier. In some arrangements the speaker signal SP may be a digital signal, with the speaker driver 210 being digitally controlled. The voltage signal $V_S$ (effectively, the potential difference maintained over the combination of the speaker 220 and the current monitoring unit 230, indicative of the potential difference maintained over the speaker 220) may be an analogue voltage signal controlled based on the speaker signal SP. Of course, the speaker signal SP may also be an analogue signal. In any event, the speaker signal SP is indicative of a voltage signal applied to the speaker. That is, the speaker driver 210 may be configured to maintain a given voltage level of the voltage signal $V_S$ for a given value for the speaker signal SP, so that the value of the voltage signal $V_S$ is controlled by or related to (e.g. proportional to, at least within a linear operating range) the value of the speaker signal SP.

The speaker 220 may comprise a dynamic loudspeaker as mentioned above. Also as mentioned above, the speaker 220 may be considered any audio transducer, including amongst others a microspeaker, loudspeaker, ear speaker, headphone, earbud or in-ear transducer, piezo speaker, and an electrostatic speaker.

The current monitoring unit 230 is configured to monitor the speaker current $I_S$ flowing through the speaker and generate a monitor signal MO indicative of that current. The monitor signal MO may be a current signal or may be a voltage signal or digital signal indicative of (e.g. related to or proportional to) the speaker current $I_S$.

The microphone signal generator 240 is connected to receive the speaker signal SP and the monitor signal MO. The microphone signal generator 240 is operable, when external sound is incident on the speaker 220, to generate a microphone signal MI representative of the external sound, based on the monitor signal MO and the speaker signal SP. Of course, the speaker voltage signal $V_S$ is related to the speaker signal SP, and as such the microphone signal generator 240 may be connected to receive the speaker voltage signal $V_S$ instead of (or as well as) the speaker signal SP, and be operable to generate the microphone signal MI based thereon. The present disclosure will be understood accordingly.

The event detector 400, which will be focussed on in more detail later herein in connection with FIGS. 9 to 14, is connected to receiver the monitor signal MO and/or the microphone signal MI. The monitor signal MO and/or the microphone signal MI, or a signal derived therefrom, may be referred to as a sensor signal SS.

The event detector 400 is operable to detect a qualifying disturbance in the sensor signal SS indicative of a qualifying pressure change incident on the speaker 220, wherein the sensor signal SS is or is derived from the monitor signal MO. The event detector 400 is further operable, in response to the detection of a qualifying disturbance, to generate an event detection signal EDS indicative of the corresponding qualifying pressure change.

The meaning of a "qualifying disturbance" and a corresponding "qualifying pressure change" will become more apparent later herein, however it will be apparent from the term "qualifying" that not all disturbances will be considered (i.e. qualify as being) a "qualifying disturbance". In the context of an in-ear headphone as in the running example, examples of qualifying pressure changes may be the pressure changes caused by the insertion into, and removal from, the ear canal of a user, and indeed these examples will be adopted more closely later herein. These of course correspond to insertion (off-ear to on-ear) and removal (on-ear to off-ear) events, respectively. A detected qualifying pressure change may be considered an "event" detected by the event detector 400.

The input connections for the event detector 400 are represented by dashed lines to indicate that it is not essential that both the monitor signal MO and the microphone signal MI be provided to the event detector 400. In this regard, in some arrangements (where the microphone signal MI is not needed) the microphone signal generator 240 may be omitted and the sensor signal may be, or be derived from, the monitor signal MO (and not the microphone signal MI). In other arrangements (where the microphone signal MI is needed and the microphone signal generator 240 is provided), the sensor signal SS may be, or be derived from, the microphone signal MI.

As above, the speaker signal SP may be received from the controller 102, and the microphone signal MI may be provided to the controller 102, in the context of the host device 100. Similarly, the event detection signal EDS may be provided to the controller 102.

Figure 4A:
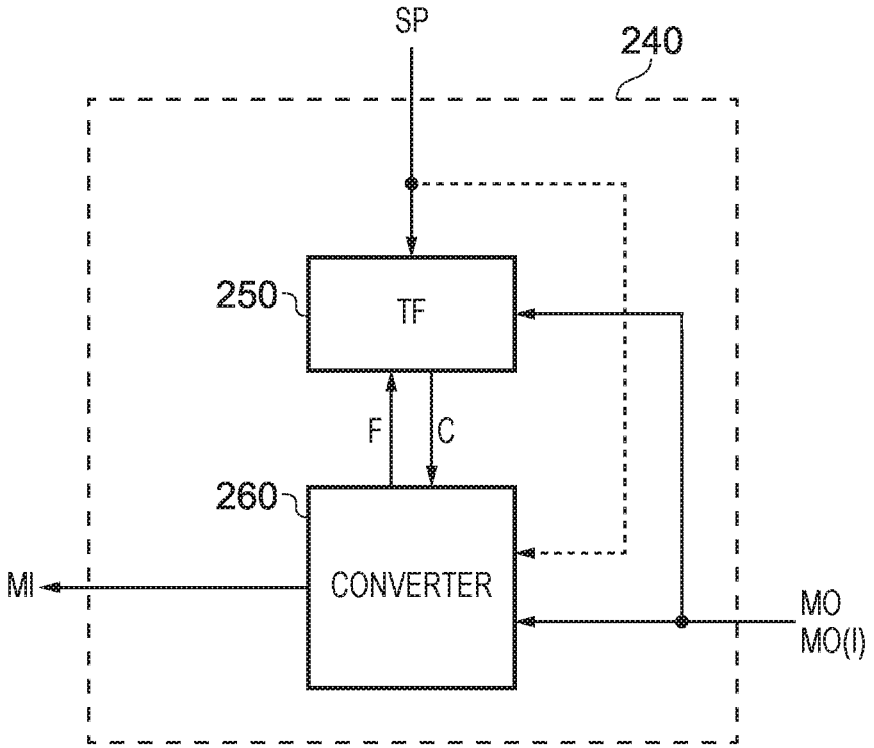
FIG. 4A is a schematic diagram of one implementation of the microphone signal generator of FIG. 3.

FIG. 4A is a schematic diagram of one implementation of the microphone signal generator 240 of FIG. 3. The microphone signal generator 240 in the FIG. 4A implementation comprises a transfer function unit 250 and a converter 260.

The transfer function unit 250 is connected to receive the speaker signal SP and the monitor signal MO, and to define and implement a transfer function which models (or is representative of, or simulates) at least the speaker 220. The transfer function may additionally model the speaker driver 210 and/or the current monitoring unit 230.

As such, the transfer function models in particular the performance of the speaker. Specifically, the transfer function (a transducer model) models how the speaker current $I_S$ is expected to vary based on the speaker signal SP (or the speaker voltage signal $V_S$) and any sound incident on the speaker 220. This of course relates to how the monitor signal MO will vary based on the same influencing factors.

By receiving the speaker signal SP and the monitor signal MO, the transfer function unit 250 is capable of defining the transfer function adaptively. That is the transfer function unit 250 is configured to determine the transfer function or parameters of the transfer function based on the monitor signal MO and the speaker signal SP. For example, the transfer function unit 250 may be configured to define, redefine or update the transfer function or parameters of the transfer function over time. Such an adaptive transfer function (enabling the operation of the converter 260 to be adapted as below) may adapt slowly and also compensate for delay and frequency response in the voltage signal applied to the speaker as compared to the speaker signal SP.

As one example, a pilot tone significantly below speaker resonance may be used (by way of a corresponding speaker signal SP) to adapt or train the transfer function. This may be useful for low-frequency response or overall gain. A pilot tone significantly above speaker resonance (e.g. ultrasonic) may be similarly used for high-frequency response, and a low-level nose signal may be used for the audible band. Of course, the transfer function may be adapted or trained using audible sounds e.g. in an initial setup or calibration phase, for example in factory calibration.

This adaptive updating of the transfer function unit 250 may operate most readily when there is no (incoming) sound incident on the speaker 220. However, over time the transfer function may iterate towards the "optimum" transfer function even when sound is (e.g. occasionally) incident on the speaker 220. Of course, the transfer function unit 250 may be provided with an initial transfer function or initial parameters of the transfer function (e.g. from memory) corresponding to a "standard" speaker 220, as a starting point for such adaptive updating.

For example, such an initial transfer function or initial parameters (i.e. parameter values) may be set in a factory calibration step, or pre-set based on design/prototype characterisation. For example, the transfer function unit 250 may be implemented as a storage of such parameters (e.g. coefficients). A further possibility is that the initial transfer function or initial parameters may be set based on extracting parameters in a separate process used for speaker protection purposes, and then deriving the initial transfer function or initial parameters based on those extracted parameters.

The converter 260 is connected to receive a control signal C from the transfer function unit 250, the control signal C reflecting the transfer function or parameters of the transfer function so that it defines the operation of the converter 260. Thus, the transfer function unit 250 is configured by way of the control signal C to define, redefine or update the operation of the converter 260 as the transfer function or parameters of the transfer function change. For example, the transfer function of the transfer function unit 250 may over time be adapted to better model at least the speaker 220.

The converter 260 (e.g. a filter) is configured to convert the monitor signal MO into the microphone signal MI, in effect generating the microphone signal MI. As indicated by the dot-dash signal path in FIG. 4A, the converter 260 (as defined by the control signal C) may be configured to generate the microphone signal MI based on the speaker signal SP and the monitor signal MO.

Note that the converter 260 is shown in FIG. 4A as also supplying a feedback signal F to the transfer function unit 250. The use of the feedback signal F in this way is optional. It will be understood that the transfer function unit 250 may receive the feedback signal F from the converter 260, such that the transfer function modelled by the transfer function unit 250 can be adaptively updated or tuned based on the feedback signal F, e.g. based on an error signal F received from the converter unit 260. The feedback signal F may be supplied to the transfer function unit 250 instead of or in addition to the monitor signal MO. In this regard, a detailed implementation of the microphone signal generator 240 will be explored later in connection with FIG. 4B.

It will be appreciated that there are four basic possibilities in relation to the speaker 220 emitting sound and receiving incoming sound. These will be considered in turn. For convenience the speaker signal SP will be denoted an "emit" speaker signal when it is intended that the speaker emits sound (e.g. to play music) and a "non-emit" speaker signal when it is intended that the speaker does not, or substantially does not, emit sound (corresponding to the speaker being silent or appearing to be off). An emit speaker signal may be termed a "speaker on", or "active" speaker signal, and have values which cause the speaker to emit sound (e.g. to play music). A non-emit speaker signal may be termed a "speaker off", or "inactive" or "dormant" speaker signal, and have a value or values which cause the speaker to not, or substantially not, emit sound (corresponding to the speaker being silent or appearing to be off).

The first possibility is that the speaker signal SP is an emit speaker signal, and that there is no significant (incoming) sound incident on the speaker 220 (even based on reflected or echoed emitted sound). In this case the speaker driver 210 is operable to drive the speaker 220 so that it emits a corresponding sound signal, and it would be expected that the monitor signal MO comprises a speaker component resulting from (attributable to) the speaker signal but no microphone component resulting from external sound (in the ideal case). There may of course be other components, e.g. attributable to circuit noise. This first possibility may be particularly suitable for the transfer function unit 250 to define/redefine/update the transfer function based on the speaker signal SP and the monitor signal MO, given the absence of a microphone component resulting from external sound. The converter 260 here (in the ideal case) outputs the microphone signal MI such that it indicates no (incoming) sound incident on the speaker, i.e. silence. Of course, in practice there may always be a microphone component if only a small, negligible one.

The second possibility is that the speaker signal SP is an emit speaker signal, and that there is significant (incoming) sound incident on the speaker 220 (perhaps based on reflected or echoed emitted sound). In this case the speaker driver 210 is again operable to drive the speaker 220 so that it emits a corresponding sound signal. Here, however, it would be expected that the monitor signal MO comprises a speaker component resulting from (attributable to) the speaker signal and also a significant microphone component resulting from the external sound (effectively due to a back EMF caused as the incident sound applies a force to the speaker membrane). There may of course be other components, e.g. attributable to circuit noise. In this second possibility, the converter 260 outputs the microphone signal MI such that it represents the (incoming) sound incident on the speaker. That is, the converter 260 effectively filters out the speaker component and/or equalises and/or isolates the microphone component when converting the monitor signal MO into the microphone signal MI.

The third possibility is that the speaker signal SP is a non-emit speaker signal, and that there is significant (incoming) sound incident on the speaker 220. In this case the speaker driver 210 is operable to drive the speaker 220 so that it substantially does not emit a sound signal. For example, the speaker driver 210 may drive the speaker 220 with a speaker voltage signal $V_S$ which is substantially a DC signal, for example at 0V relative to ground. Here, it would be expected that the monitor signal MO comprises a significant microphone component resulting from the external sound but no speaker component. There may of course be other components, e.g. attributable to circuit noise. In the third possibility, the converter 260 outputs the microphone signal MI again such that it represents the (incoming) sound incident on the speaker. In this case, the converter effectively isolates the microphone component when converting the monitor signal MO into the microphone signal MI.

The fourth possibility is that the speaker signal SP is a non-emit speaker signal, and that there is no significant (incoming) sound incident on the speaker 220. In this case the speaker driver 210 is again operable to drive the speaker 220 so that it substantially does not emit a sound signal. Here, it would be expected that the monitor signal MO comprises neither a significant microphone component nor a speaker component. There may of course be other components, e.g. attributable to circuit noise. In the fourth possibility, the converter 260 outputs the microphone signal MI such that it indicates no (incoming) sound incident on the speaker, i.e. silence.

At this juncture, it is noted that the monitor signal MO is indicative of the speaker current $I_S$ rather than a voltage such as the speaker voltage signal $V_S$, and as such it may also be referred to as monitor signal MO(I) as in FIGS. 2 and 3A to indicate that it is indicative of the speaker current (I). Although it would be possible for the monitor signal MO to be indicative of a voltage such as the speaker voltage signal $V_S$ in a case where the speaker driver 210 is effectively disconnected (such that the speaker 220 is undriven) and replaced with a sensing circuit (such as an analogue-to-digital converter), in which case the monitor signal MO might be referred to as the monitor signal MO(V), this mode of operation may be unsuitable or inaccurate where the speaker 220 is driven by the speaker driver 210 (both where the speaker signal SP is a non-emit speaker signal and an emit speaker signal) and there is significant sound incident on the speaker 220.

Put another way, when the transducer 220 (here, speaker 220) is driven with a voltage from the driver 210 the sensing circuitry (e.g. monitoring unit 230 of FIG. 3) operates in current mode to provide a corresponding monitor signal MO(I). When the driver 210 is disabled, there is no circuitry (in the driver 210) forcing a voltage at $V_S$. Hence, if that node is floating (as regards the driver 210), it is possible to operate in voltage mode and measure the back EMF directly across the transducer 220, and provide a corresponding monitor signal MO(V). Effectively, in this mode the voltage at $V_S$ is driven by the transducer 220 itself.

The speaker driver 210 (when enabled or operational) effectively forces the speaker voltage signal $V_S$ to have a value based on the value of the speaker signal SP as mentioned above. Thus, any induced voltage effect (Vemf due to membrane displacement) of significant sound incident on the speaker 220 would be largely or completely lost in e.g. the speaker voltage signal $V_S$ given the likely driving capability of the speaker driver 210. However, the speaker current $I_S$ in this case would exhibit components attributable to the speaker signal and also any significant incident external sound, which translate into corresponding components in the monitor signal MO (where it is indicative of the speaker current $I_S$) as discussed above. As such, having the monitor signal MO indicative of the speaker current $I_S$ as discussed above, i.e. as monitor signal MO(I), enables a common architecture to be employed for all four possibilities mentioned above.

Although not explicitly shown in FIG. 3A, the converter 260 may be configured to perform conversion so that the microphone signal MI is output as a signal which is more usefully representative of the external sound (e.g. as a sound pressure level, SPL, signal). Such conversion may involve some scaling and possibly some equalisation over frequency, for example. The monitor signal MO here is indicative of the current signal $I_S$, and may even be a current signal itself. However, the circuitry such as controller 102 receiving the microphone signal MI may require that signal MI to be a sound pressure level (SPL) signal. The converter 260 may be configured to perform the conversion in accordance with a corresponding conversion function. As such, the converter 260 may comprise a conversion function unit (not shown) equivalent to the transfer function unit 250 and which is similarly configured to update, define or redefine the conversion function being implemented in an adaptive manner, for example based on any or all of the monitor signal MO, the speaker signal SP, the microphone signal MI, the feedback signal F, and the control signal C.

The skilled person will appreciate, in the context of the speaker 220, that the transfer function and/or the conversion function may be defined at least in part by Thiele-Small parameters. Such parameters may be reused from speaker protection or other processing. Thus, the operation of the transfer function unit 250, the converter 260 and/or the conversion function unit (not shown) may be defined at least in part by such Thiele-Small parameters. As is well known, Thiele-Small parameters (Thiele/Small parameters, TS parameters or TSP) are a set of electromechanical parameters that define the specified low frequency performance of a speaker. These parameters may be used to simulate or model the position, velocity and acceleration of the diaphragm, the input impedance and the sound output of a system comprising the speaker and its enclosure.

Figure 4B:
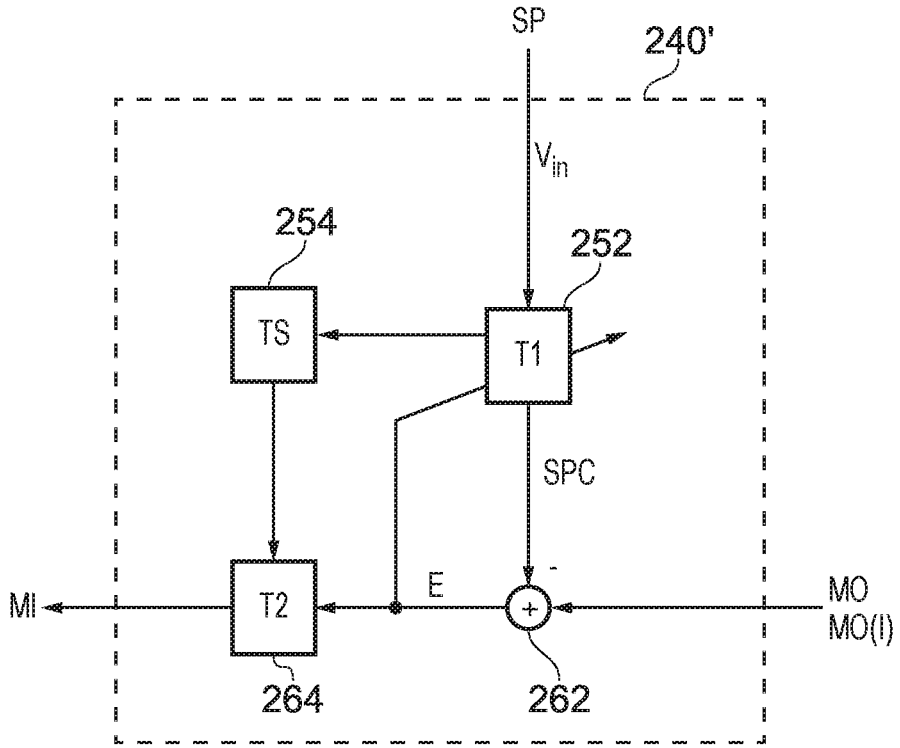
FIG. 4B is a schematic diagram of another implementation of the microphone signal generator of FIG. 3.

FIG. 4B is a schematic diagram of one implementation of the microphone signal generator 240 of FIG. 2, here denoted 240'. The microphone signal generator 240' in the FIG. 4B implementation comprises a first transfer function unit 252, an adder/subtractor 262, a second transfer function unit 264 and a TS parameter unit 254.

The first transfer function unit 252 is configured to define and implement a first transfer function, T1. The second transfer function unit 264 is configured to define and implement a second transfer function, T2. The TS parameter unit 254 is configured to store TS (Thiele-Small) parameters or coefficients extracted from the first transfer function T1 to be applied to the second transfer function T2.

The first transfer function, T1, may be considered to model at least the speaker 220. The first transfer function unit 252 is connected to receive the speaker signal SP (which will be referred to here as Vin), and to output a speaker current signal SPC indicative of the expected or predicted (modelled) speaker current based on the speaker signal SP.

The adder/subtractor 262 is connected to receive the monitor signal MO (indicative of the actual speaker current IS, i.e. monitor signal MO(I)) and the speaker current signal SPC, and to output an error signal E which is indicative of the residual current representative of the external sound incident on the speaker 220. As indicated in FIG. 4B, the first transfer function unit 252, and as such the first transfer function T1, is configured to be adaptive based on the error signal E supplied to the first transfer function unit 252. The error signal E in FIG. 4B may be compared with the feedback signal F in FIG. 4A.

The second transfer function, T2, may be suitable to convert the error signal output by the adder/subtractor 262 into a suitable SPL signal (forming the microphone signal MI) as mentioned above. Parameters or coefficients of the first transfer function T1 may be stored in the TS parameter unit 254 and applied to the second transfer function T2.

The first transfer function T1 may be referred to as an adaptive filter. The parameters or coefficients (in this case, Thiele-Small coefficients TS) of the first transfer function T1 may be extracted and applied to the second transfer function T2, by way of the TS parameter unit 254, which may be a storage unit. The second transfer function T2 may be considered an equalisation filter.

Looking at FIG. 4B, for example, T2 is the transfer function applied between E and MI, hence T2=(MI/E), or MI=T2*E, where E=(MO−SPC). Similarly, T1=(SPC/SP), or SPC=T1*SP.

Example transfer functions T1 and T2 derived from Thiele-Small modelling may comprise:

$$T1 = \frac{Vin}{R + s\left(L + \frac{Bl^2 \cdot Cms}{1 + s \cdot Cms(\mathrm{Rms} + Mms)}\right)}$$

$$T2 = -\frac{R(1 + s \cdot Cms(\mathrm{Rms} + Mms)) + s(L + Cms(-Bl^2 + L.s(\mathrm{Rms} + Mms)))}{s \cdot Bl \cdot Cms}$$

where:

Vin is the voltage level of (or indicated by) the speaker signal SP;

R is equivalent to Re, which is the DC resistance (DCR) of the voice coil measured in ohms (Ω), and best measured with the speaker cone blocked, or prevented from moving or vibrating;

L is equivalent to Le, which is the inductance of the voice coil measured in millihenries (mH);

BI is known as the force factor, and is a measure of the force generated by a given current flowing through the voice coil of the speaker, and is measured in tesla metres (Tm);

Cms describes the compliance of the suspension of the speaker, and is measured in metres per Newton (m/N);

Rms is a measurement of the losses or damping in the speaker's suspension and moving system. Units are not normally given but it is in mechanical 'ohms';

Mms is the mass of the cone, coil and other moving parts of a driver, including the acoustic load imposed by the air in contact with the driver cone, and is measured in grams (g) or kilograms (kg);

s is the Laplace variable; and

In general, reference regarding Thiele-Small parameters may be made to Beranek, Leo L. (1954). Acoustics. NY: McGraw-Hill.

Figure 5:
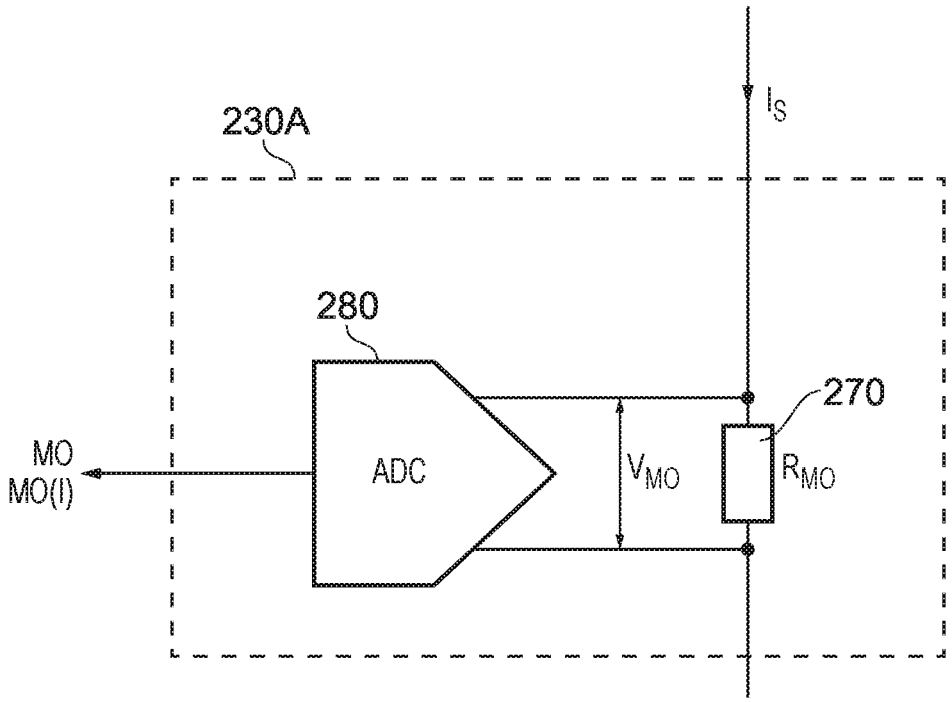
FIG. 5 is a schematic diagram of an example current monitoring unit, as an implementation of the current monitoring unit of FIG. 3.

FIG. 5 is a schematic diagram of an example current monitoring unit 230A which may be considered an implementation of the current monitoring unit 230 of FIG. 3. The current monitoring unit 230A may thus be used in place of the current monitoring unit 230.

The current monitoring unit 230A comprises an impedance 270 and an analogue-to-digital converter (ADC) 280. The impedance 270 is in the present arrangement a resistor having a monitoring resistance $R_{MO}$, and is connected in series in the current path carrying the speaker current $I_S$. Thus a monitoring voltage $V_{MO}$ is developed over the resistor 270 such that:

$$V_{MO}=I_S \times R_{MO}$$

The monitoring voltage $V_{MO}$ is thus proportional to the speaker current $I_S$ given the fixed monitoring resistance $R_{MO}$ of the resistor 270. Indeed, it will be appreciated from the above equation that the speaker current $I_S$ could readily be obtained from the monitoring voltage $V_{MO}$ given a known $R_{MO}$.

The ADC 280 is connected to receive the monitoring voltage $V_{MO}$ as an analogue input signal and to output the monitor signal MO as a digital signal. The microphone signal generator 240 (including the transfer function unit 250 and converter 260) may be implemented in digital such that the speaker signal SP, the monitor signal MO and the microphone signal MI are digital signals.

Figure 6:
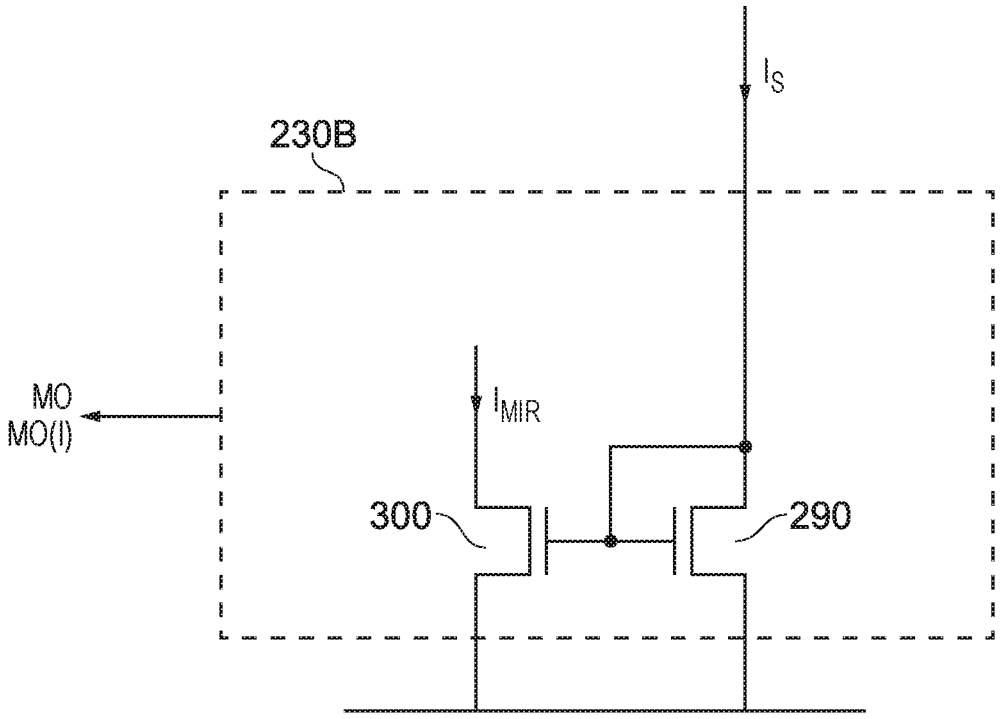
FIG. 6 is a schematic diagram of another example current monitoring unit, as an implementation of the current monitoring unit of FIG. 3.

FIG. 6 is a schematic diagram of an example current monitoring unit 230B which may be considered an implementation of the current monitoring unit 230 of FIG. 3. The current monitoring unit 230B may thus be used in place of the current monitoring unit 230, and indeed along with elements of the current monitoring unit 230A as will become apparent. Other known active sensing techniques such as a current mirror with drain-source voltage matching may be used.

The current monitoring unit 230B comprises first and second transistors 290 and 300 connected in a current-mirror arrangement. The first transistor 290 is connected in series in the current path carrying the speaker current $I_S$ such that a mirror current $I_{MIR}$ is developed in the second transistor 300. The mirror current $I_{MIR}$ may be proportional to the speaker current $I_S$ dependent on the current-mirror arrangement (for example, the relative sizes of the first and second transistors 290 and 300). For example, the current-mirror arrangement may be configured such that the mirror current $I_{MIR}$ is equal to the speaker current $I_S$. In FIG. 6, the first and second transistors 290 and 300 are shown as MOSFETs however it will be appreciated that other types of transistor (such as bipolar junction transistors) could be used.

The current monitoring unit 230B is configured to generate the monitor signal MO based on the mirror current $I_{MIR}$. For example, an impedance in the path of the mirror current $I_{MIR}$ along with an ADC—equivalent to the impedance 270 and ADC 280 of FIG. 5—could be used to generate the monitor signal MO based on the mirror current $I_{MIR}$, and duplicate description is omitted.

It will be appreciated from FIG. 3 that the audio circuitry 200 could be provided without the speaker 220, to be connected to such a speaker 220. The audio circuitry 220 could also be provided with the controller 102 or other processing circuitry, connected to supply the speaker signal SP and/or receive the microphone signal MI. Such processing circuitry could act as a speaker-signal generator operable to generate the speaker signal SP. Such processing circuitry could act as a microphone-signal analyser operable to analyse the microphone signal MI.

Focus will now be returned to the event detector 400 of FIG. 3, to better understand its function in the audio circuitry (transducer circuitry) 200. It is recalled that the event detector 400 is operable to detect a qualifying disturbance in the sensor signal SS indicative of a qualifying pressure change incident on the speaker 220, wherein the sensor signal SS is or is derived from the monitor signal MO. Moreover, in the context of an in-ear headphone, examples of qualifying pressure changes may be the pressure changes caused by the insertion into, and removal from, the ear canal of a user of the in-ear headphone. It is recalled that these correspond to insertion and removal events, and transitions between deployed and non-deployed states (on-ear and off-ear states).

Figure 7:
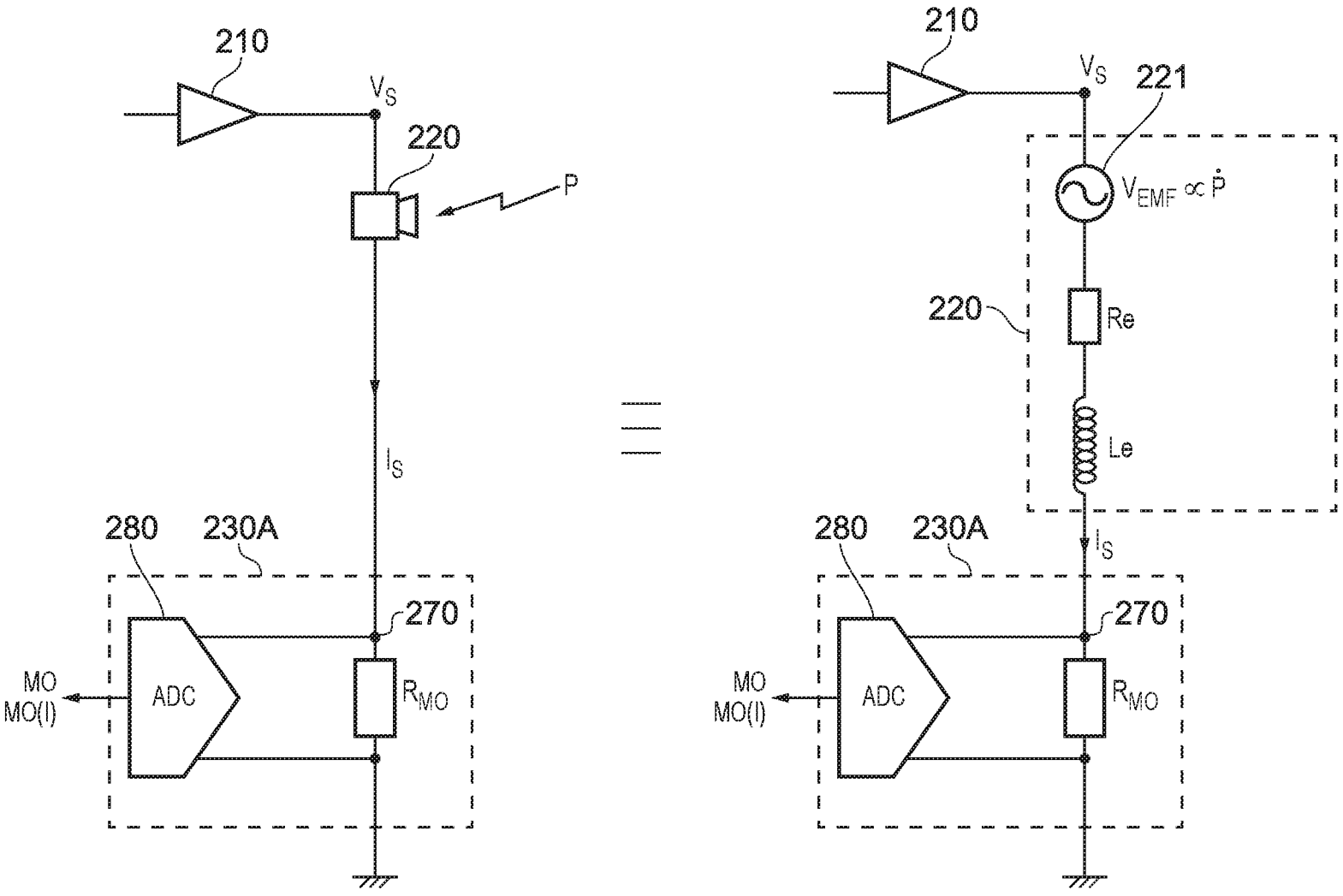
FIG. 7 is a schematic diagram showing parts of the audio circuitry of FIG. 3, alongside an equivalent circuit.

FIG. 7 is a schematic diagram showing parts of the audio circuitry (transducer circuitry) 200 of FIG. 3, alongside an equivalent circuit. The current monitoring unit 230 is represented as the implementation 230A of FIG. 5, as an example. In the equivalent circuit, the speaker (transducer) 220, in particular, is shown as an equivalent circuit comprising a series connection of a voltage source 221 a resistance Re and an inductance Le.

Also indicated in FIG. 7 is the effect of ambient pressure p on the speaker 220. From Faraday's law, and considering the speaker as a (dynamic) loudspeaker in which a voice coil and a magnet move relative to one another, a back EMF induced in the speaker by movement of the speaker diaphragm under an applied force will appear as a voltage $V_{EMF}$ at the voltage source 221 as follows:

$$V_{EMF} \propto \dot{\Phi}_B$$

where $\dot{\varphi}_B$ is the rate of change of magnetic flux experienced at the voice coil with respect to time. Since the rate of change of the magnetic flux is proportional to the rate of change of ambient pressure p incident on the speaker, it follows that:

$$V_{EMF} \propto \dot{p}$$

Looking at the current monitoring unit 230A, the back EMF voltage $V_{EMF}$ in the case of an undriven speaker 220 may be taken to appear across the resistor 270, such that:

$$I_S \propto \frac{V_{EMF}}{R_{MO}}$$

Thus, it may also be said that (for a DC step response):

$$I_S \propto \dot{p}$$

Figure 8:
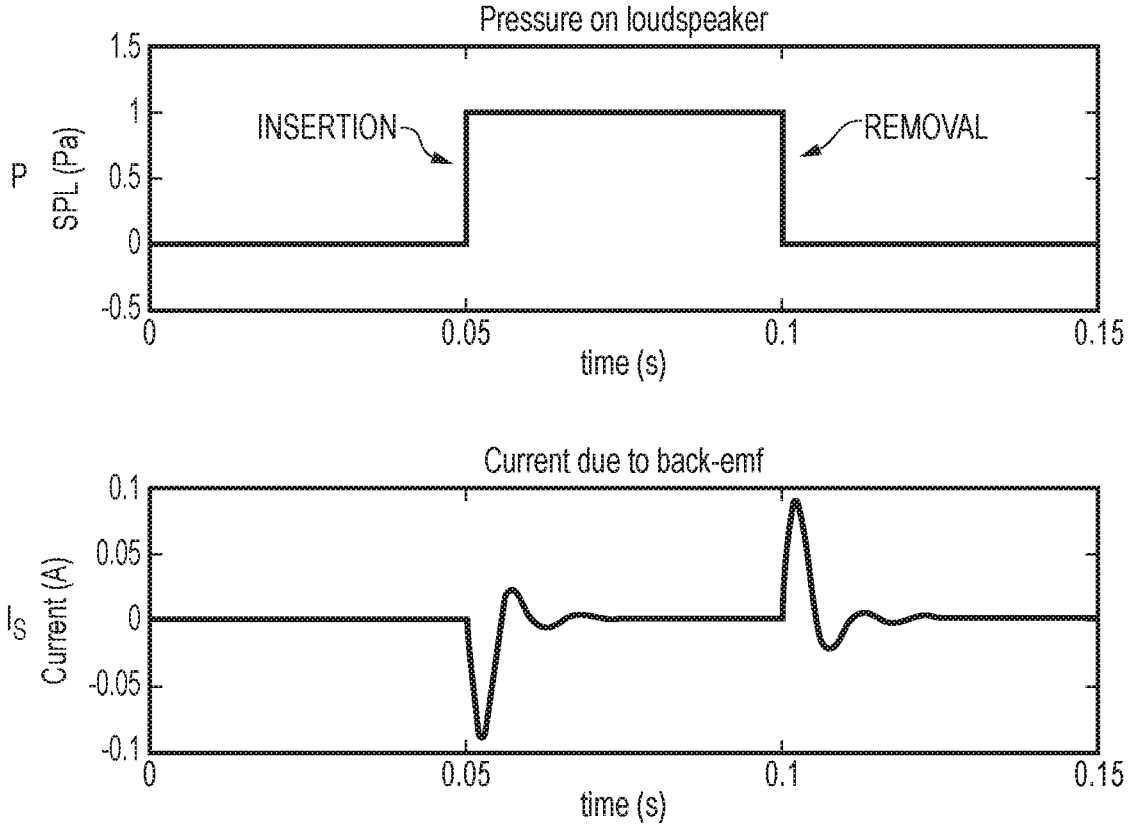
FIG. 8 shows graphs generated based on a simulation of the speaker of FIG. 3 in which the ambient pressure p incident on the speaker undergoes a succession of step changes.

With the above in mind, reference is made to FIG. 8, which shows graphs generated based on a simulation of speaker 220 in which the ambient pressure p incident on the speaker undergoes a succession of step changes which effect the speaker current $I_S$.

As indicated in FIG. 8, the ambient pressure p undergoes a first step change, in which the pressure p increases, followed by a second step change, in which the pressure p decreases back to its original value. The pressure p is plotted as an SPL signal in Pascal. Although the pressure p signal is shown as a DC signal which step changes from one value to another and back again, this is of course for simplicity. It will be appreciated that in an actual implementation the pressure p signal may have a DC component (corresponding to the signal shown FIG. 8) with an AC component (corresponding e.g. to an indecent sound signal) superimposed thereon. The step changes in pressure p in FIG. 8 may thus be considered representative of step changes in DC, or steady state value.

As also indicated in FIG. 8, the speaker current $I_S$ experiences a disturbance as a result of both of the step changes in the pressure p. These disturbances may each be referred to as ringing (e.g. comprising a spike) in the speaker current $I_S$. Effectively, the speaker current $I_S$ is proportional to the rate of change of the pressure p with respect to time, as in the equations above. Note that the polarities of the first and second step changes in the pressure p are different (opposite from one another), and consequently the polarities of the corresponding spikes or ringing in the speaker current $I_S$ are also different (opposite from one another). From FIG. 7, it can be appreciated that the speaker current $I_S$ corresponds to (e.g. is proportional to) the monitor signal MO, and thus also to the sensor signal SS (see FIG. 3).

Returning to the in-ear headphone running example, the first and second step changes are examples of qualifying pressure changes and may be considered to correspond respectively to the insertion into, and removal from, the ear canal of a user of the in-ear headphone. These correspond to insertion and removal events, and transitions between deployed and non-deployed states (on-ear and off-ear states). Put simply, when an in-ear headphone is inserted into the ear canal of a user (off-ear to on-ear) the ambient pressure incident on its speaker may increase in line with the first step change in FIG. 8. Similarly, when an in-ear headphone is removed from the ear canal of a user (on-ear to off-ear) the ambient pressure incident on its speaker may decrease in line with the second step change in FIG. 8.

Figure 9:
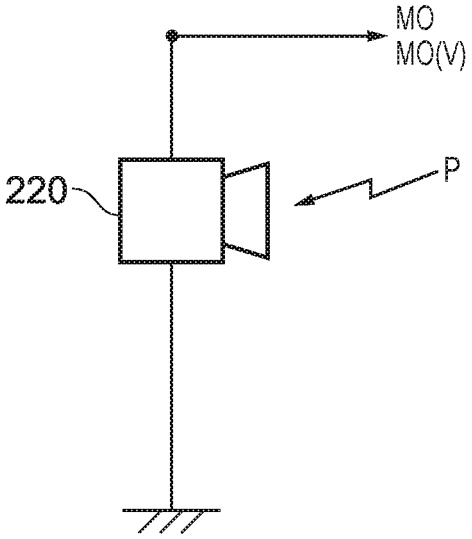
FIG. 9 is a schematic diagram indicating that the voltage across the speaker of FIG. 3 may form a monitor signal in certain use cases.

FIG. 9 is a schematic diagram for a case where the speaker 220 is in an undriven state, in terms of the speaker driver 210. For example, if the speaker driver 210 is powered down and the voltage $V_S$ is effectively driven by the speaker 220 rather than the driver 210, the back EMF induced in the speaker 220 by a change in the pressure p may be measured as a voltage signal (effectively $V_{EMF}$) across the speaker 220. This voltage signal (effectively $V_{EMF}$) may itself serve as the monitor signal MO, in this case MO(V). Based on the equations above, disturbances may occur in such a monitor signal MO(V) corresponding to those in the speaker current $I_S$ shown in FIG. 8 in response to the step changes in the pressure p.

Thus, a variation of the audio circuitry 200 of FIG. 3 may comprise the speaker 220 connected to the event detector 400 in line with FIG. 9, with the (current) monitoring unit 230 is replaced with a (voltage) monitoring unit implemented effectively as a tap point at the upper terminal of the speaker 220 (where signal $V_S$ is shown), and with the microphone signal generator 240 (and in some cases, also the speaker driver 210) omitted.

Figure 10:
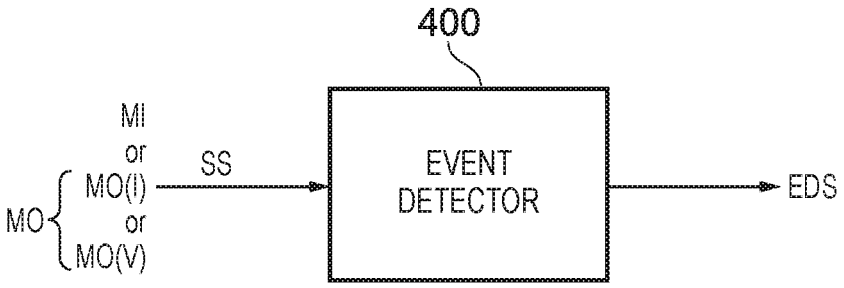
FIG. 10 is a schematic diagram of the event detector of FIG. 3, for use in understanding its potential use in a variety of sets of audio circuitry.

In the light of the above, and with reference to FIG. 10, the event detector 400 is operable to detect a qualifying disturbance in the sensor signal SS where an example qualifying disturbance corresponds to one of the disturbances in the speaker current Is as shown in FIG. 8. The sensor signal SS may be, or be derived from the microphone signal MI or the monitor signal MO (whether it is the monitor signal MO(I) or MO(V)). Such a qualifying disturbance is then taken as indicative of a qualifying pressure change incident on the speaker 220, for example corresponding to one of the step changes in the pressure p shown in FIG. 7.

Qualifying disturbances in the sensor signal SS (and thus corresponding qualifying pressure changes) may be detected by comparing the sensor signal SS to a corresponding qualifying specification which defines at least one qualifying disturbance, and determining if a candidate disturbance in the sensor signal SS meets or satisfies the qualifying specification. A qualifying specification may thus include at least one of: a definition of a qualifying criterion or of qualifying criteria; a configuration for a neural network or classifier implemented by the event detector; a threshold value, such as magnitude value or a rate of change value; an average value, such as a running average value; a peak magnitude; a rise time; a time constant; a settling time; and a frequency response value. A qualifying specification may include configuration settings/details/parameters relating to any of cepstral techniques (including MFCCs); statistical distance metrics such as KL divergence or ECDF-derived metrics; simple distance metrics such as Euler distance, Mahalanobis distance; and UBM-based techniques (universal background model) or GMM (Gaussian mixture model).

Figure 11:
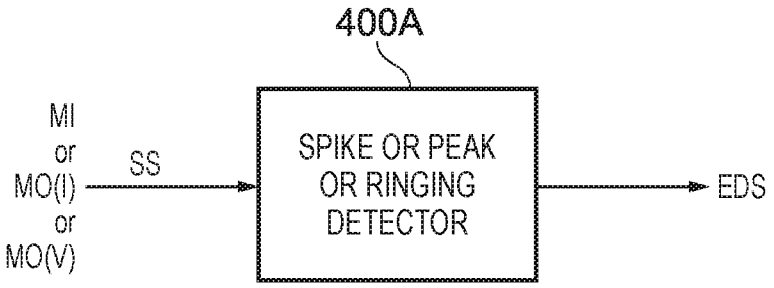
FIGS. 11 to 15 are schematic diagrams of example implementations of the event detector of FIG. 10.

Looking at FIG. 8, the event detector 400 may thus be implemented as a spike or ringing or peak detector in line with the example implementation 400A of FIG. 11.

The skilled person will understand that a spike, peak or ringing detector may be configured to distinguish a qualifying disturbance in the sensor signal SS from other (non-qualifying) disturbances, such as a tiny "ripple" attributable to ambient noise or incident sound for example. A spike, peak or ringing detector may also be configured to distinguish one type of qualifying disturbance in the sensor signal SS from another, for example having opposite polarities in line with those shown FIG. 8.

For example, the spike, peak or ringing detector may be configured to judge that a qualifying disturbance is present in the sensor signal SS based on comparing that signal to a threshold value, such as a magnitude value, a rate of change value, an average value, a running average value, a peak magnitude, a rise or fall time, a time constant, a settling time, and/or a frequency response value.

The resultant event detection signal EDS may thus indicate merely that a qualifying disturbance (and thus a qualifying pressure change) has been detected, or that a specific type of qualifying disturbance (and thus a corresponding specific type of qualifying pressure change) has been detected. In the latter case, taking the running example of an in-ear headphone, one of the types may correspond to insertion into the ear canal of a user (insertion event—transition from off-ear to on-ear) and the other type may correspond to removal from the ear canal (removal event—transition from on-ear to off-ear).

Figure 12:
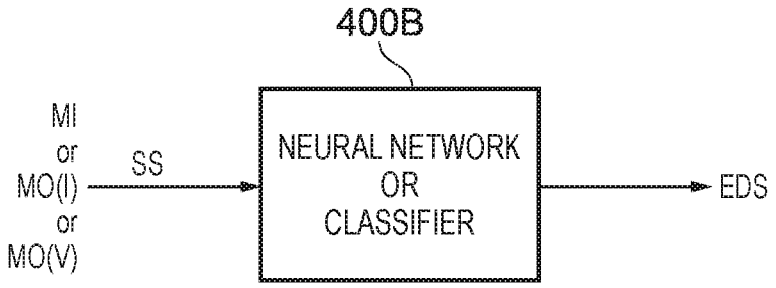

As another example, the event detector 400 may be implemented as a neural network or other classifier in line with the example implementation 400B of FIG. 12. Similarly to the above, the skilled person will understand that a neural network may be configured (e.g. through training or by stored configuration settings/parameters) to distinguish a qualifying disturbance in the sensor signal SS from other (non-qualifying) disturbances, and/or distinguish one type of qualifying disturbance in the sensor signal SS from another, with the event detection signal EDS configured accordingly.

Figure 13:
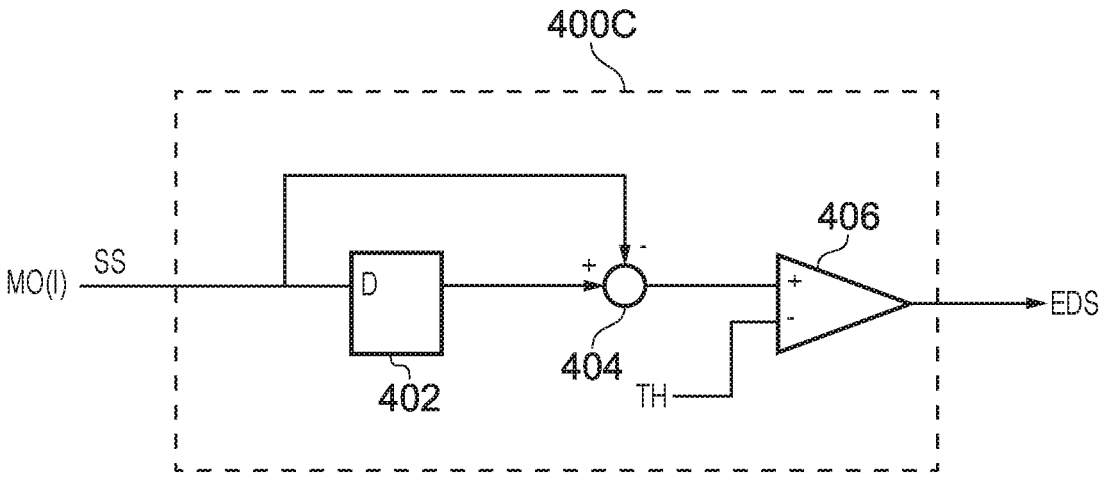

FIG. 13 is a schematic diagram of an example implementation 400C of the event detector 400 in which it is configured as a "spike" (ringing) detector. The sensor signal SS is assumed to be the monitor signal MO(I) in the case where it is a digital signal (e.g. output by the ADC 280) representative of the speaker current $I_S$.

A delay block 402 and adder 404 are configured to find the difference between consecutive samples of the sensor signal SS, and this difference is then compared to a threshold value TH by a comparator 406. If the threshold value TH is exceeded, a spike (i.e. a sudden increase, or drop, in the sensor signal SS) has been detected, and the event detection signal EDS indicates the detection of the spike. The threshold value TH may be set accordingly, and indeed different threshold values TH may be used to detect different types of spike, such as different polarities of spike (see FIG. 8).

Figure 14:
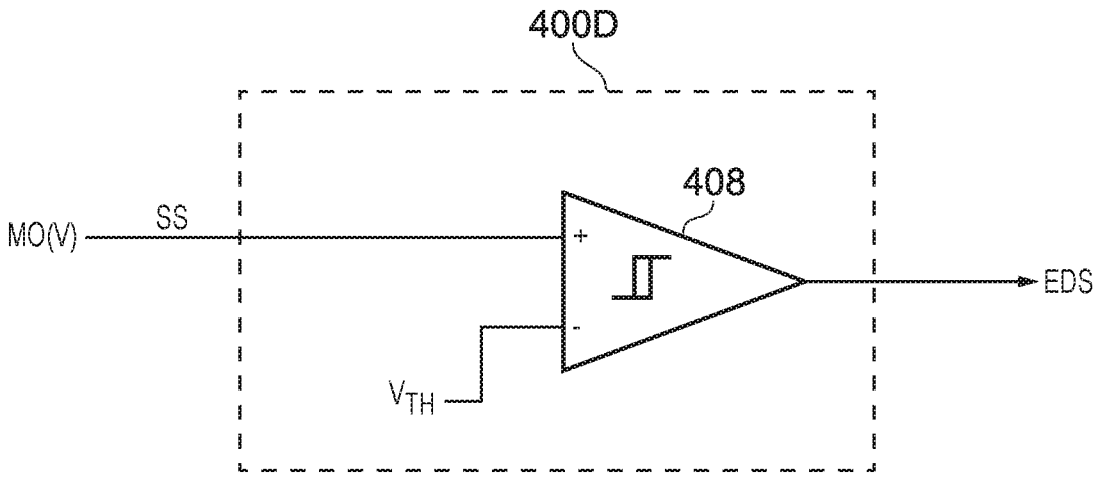

FIG. 14 is a schematic diagram of an example implementation 400D of the event detector 400 in which it is configured as a peak detector. The sensor signal SS is assumed to be the monitor signal MO(V) in the case where it is an analogue voltage signal (see FIG. 9) representative of the back EMF induced in the speaker 220.

The sensor signal SS is applied to a comparator, preferably with hysteresis, along with a threshold voltage signal $V_{TH}$. If the threshold voltage $V_{TH}$ is exceeded, a peak has been detected, and the event detection signal EDS indicates the detection of the peak. The threshold voltage $V_{TH}$ may be set accordingly, and indeed different threshold voltages $V_{TH}$ may be used to detect different types of peak, such as different polarities of peak (see FIG. 8).

Figure 15:
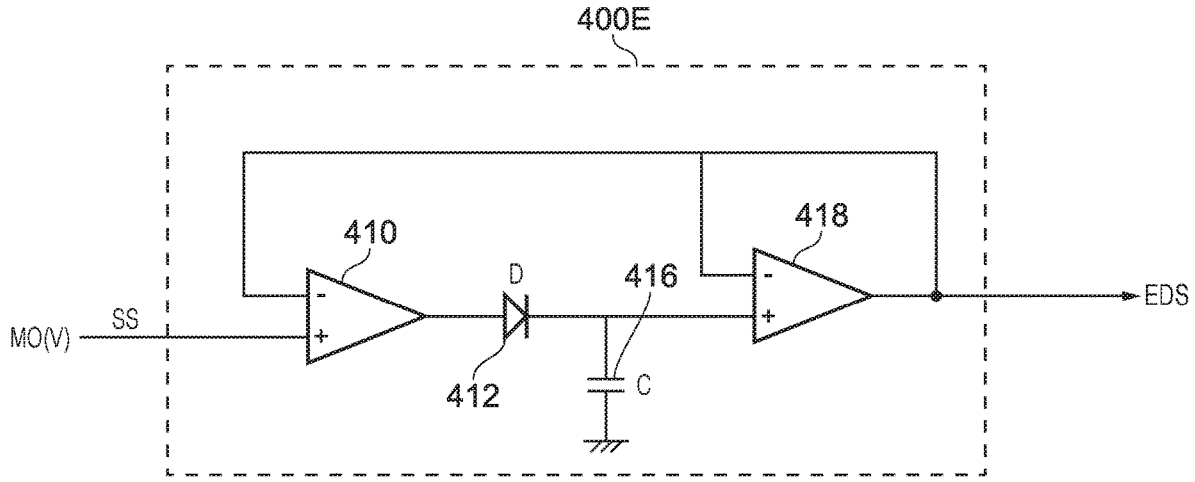

FIG. 15 is a schematic diagram of an example implementation 400E of the event detector 400 in which it is configured as a peak detector, enhanced as compared to that in FIG. 14 (for example, for high precision and in case a narrow spike occurs). The sensor signal SS is again assumed to be the monitor signal MO(V) in the case where it is an analogue voltage signal (see FIG. 9) representative of the back EMF induced in the speaker 220.

The skilled person will understand that the peak detector of implementation 400E is merely one example of a range of peak detector circuits, whose operation in general is known. Nevertheless, for completeness, in the peak detector of FIG. 14 the op-amps (operational amplifiers) 410 and 418 are configured as voltage followers, with the intermediate diode 412 and capacitor 416 acting as a peak detector. The diode 412 acts as a rectifier so that the voltage stored over the capacitor 416 tracks increasing peaks in the sensor signal SS and stores the peak value, which then appears as the output signal, in this case, the event detection signal EDS. The op-amp 418 acts as a comparator.

As above, the event detection signal EDS may be provided to the controller 102, in response to which the controller 120 may control operation of the host device 100.

Figure 16:
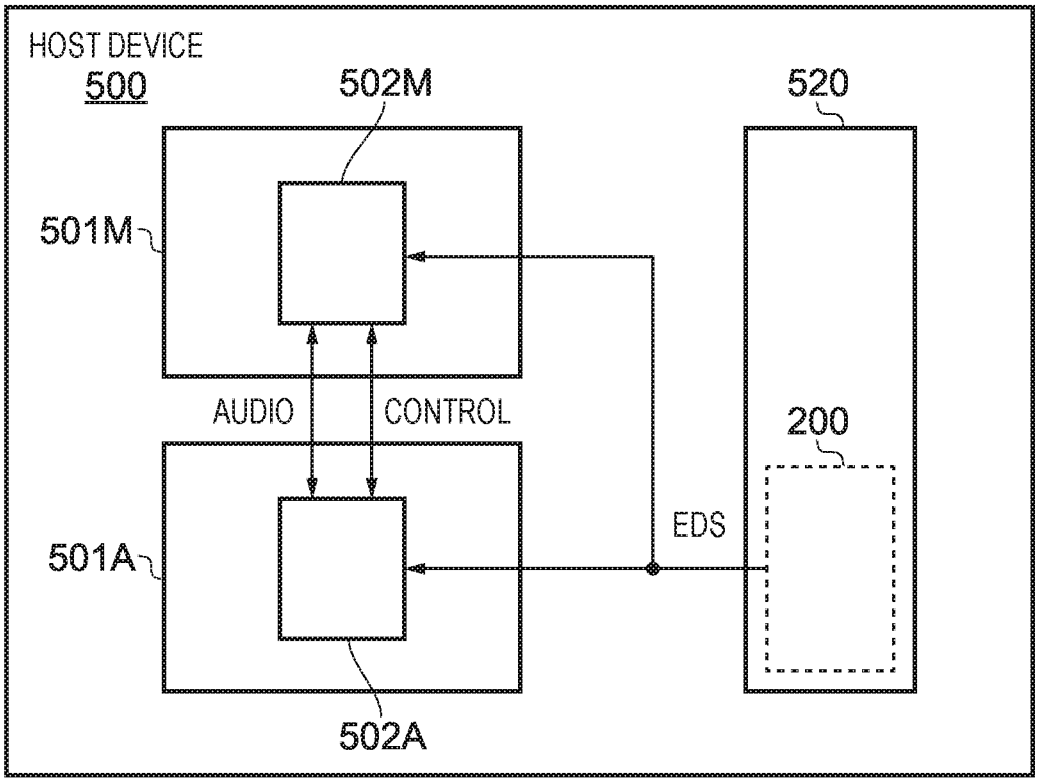
FIG. 16 is a schematic diagram of another host device.

FIG. 16 is a schematic diagram of a host device 500, which may be described as (or as comprising) an audio processing system. Host device 500 corresponds to host device 100, and as such host device 100 may also be described as (or as comprising) an audio processing system. Host device 500 will be taken here to be an in-ear headphone, in line with the running example (although this just an example). However, the elements of host device 500 explicitly shown in FIG. 16 correspond only to a subset of the elements of host device 100 for simplicity.

The host device 500 is organised into an "always on" domain 501A and a "main" domain 501M. An "always on" controller 502A is provided in domain 501A and a "main" controller 502M is provided in domain 501M. The controllers 502A and 502M may be considered individually or collectively equivalent to the controller 102 of FIG. 2.

As described earlier, the host device 500 may be operable in a low-power state in which elements of the "always on" domain 501A are active and elements of the "main" domain 501M are inactive (e.g. off or in low-power state). The host 500 may be "woken up", transitioning it to a higher-power state in which the elements of the "main" domain 501M are active.

The host device 500 comprises an input/output unit 520 which may comprise one or more elements corresponding to elements 106, 108, 110 and 112 of FIG. 2. In particular, the input/output unit 520 comprises at least one set of audio circuitry 200 as indicated, which corresponds to a speaker unit 112 of FIG. 2.

As shown in FIG. 16, audio and/or control signals may be exchanged between the "always on" controller 502A and the "main" controller 502M. Also, one or both of the controllers 502A and 502M may be connected to receive the event detection signal EDS from the audio circuitry 200. Although not shown, one or both of the controllers 502A and 502M may be connected to supply the speaker signal SP to the audio circuitry 200.

For example, the "always on" controller 502A may be configured to operate an insertion detect algorithm (detection of the insertion of the in-ear headphone into the ear canal of a user, or an insertion event, or an off-ear to on-ear state transition) based on analysing or processing the event detection signal EDS, and to wake up the "main" controller 502M via the control signals as shown when a suitable event detection signal EDS is received. As an example, the event detection signal EDS may be handled by the "always on" controller 502A initially and routed via that controller to the "main" controller 502M until such time as the "main" controller 502M is able to receive the event detection signal EDS directly. In one example use case the host device 500 may be located on a table, in a pocket or in a storage container (i.e. not in the ear canal of a user) and it may be desirable to use the speaker 220 as a sensor to detect insertion of the in-ear headphone into the ear canal. Such detection may be carried out by the "always on" controller 502A monitoring in the event detection signal EDS while the host device 500 is in its low-power state.

As another example use case, the "main" controller 502M once woken up—e.g. because the host device 500 is deployed (plugged into the ear canal of a user)—may be configured to play audio (e.g. music) in response to corresponding control from the user. The "main" controller may also operate a removal detect algorithm (detection of the removal of the in-ear headphone from the ear canal of a user or a removal event, or an on-ear to off-ear state transition) based on analysing or processing the event detection signal EDS, and to enter the low-power state when a suitable event detection signal EDS is received. In such a case, it may be desirable to use the speaker 220 as a microphone (so that the microphone signal MI is available as the sensor signal SS) to detect removal of the in-ear headphone from the ear canal of a user, even when audio is being played.

Of course, these are just example use cases of the host device 500 (and similarly of the host device 100). Other example use cases will occur to the skilled person based on the present disclosure.

The skilled person will appreciate that by using the speaker 220 as a sensor to detect a qualifying disturbance in the sensor signal SS (indicative of a qualifying pressure change incident on the speaker 220), insertion and removal events may be detected with relatively low associated power requirements. For example, the event detectors of FIGS. 13 to 15 have particularly low power requirements. It the case of detection of an insertion event, power requirements may be particularly important as the host device 500 (or 100) may be in a particularly low-power state awaiting deployment. The event detectors of FIGS. 14 and 15 may be particularly useful in this respect.

Figure 17A:
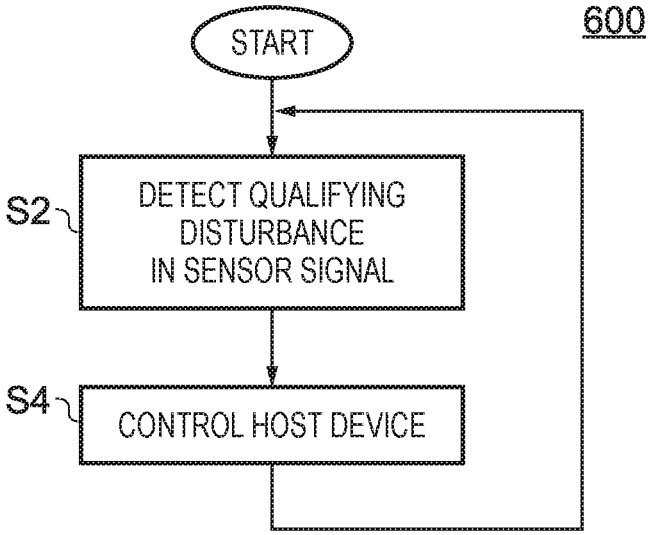
FIGS. 17A to 17D present methods which may be carried out by the host device of FIG. 2 or 16.

FIG. 17A is a schematic diagram of a method 600 which may be carried out by the host device 100 or 500, for example by the controller and/or audio circuitry thereof. The method comprises, detecting (step S2) a qualifying disturbance in the sensor signal SS indicative of a qualifying pressure change incident on the speaker 220, and controlling (step S4) the host device in response to the detection. Such control may comprise entering a high-power mode of operation from a low-power mode of operation, or vice versa. The method 600 may then return to step S2 and continue to cycle through until, for example, the host device is powered down.

Figure 17B:
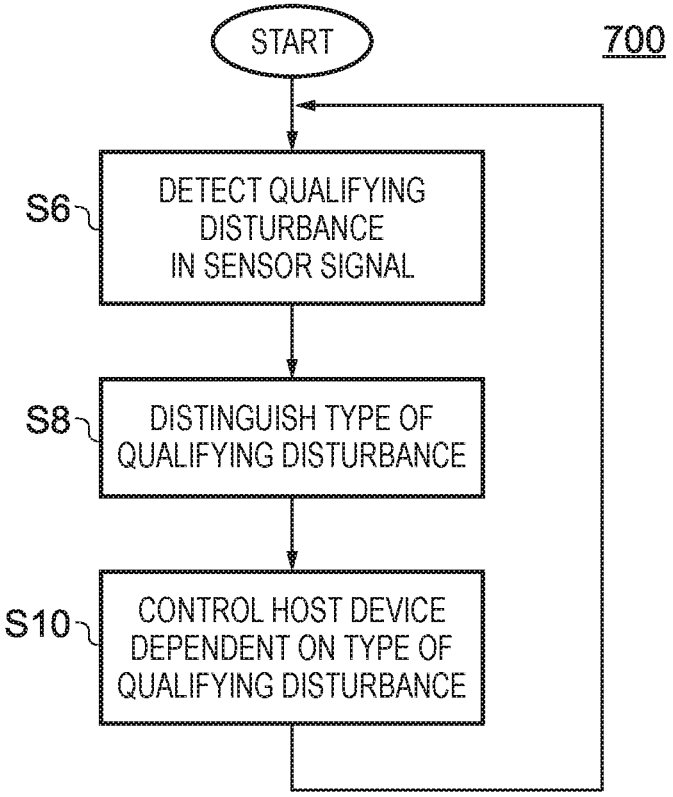

FIG. 17B is a schematic diagram of a method 700 which may be carried out by the host device 100 or 500, for example by the controller and/or audio circuitry thereof. The method comprises, detecting (step S6) a qualifying disturbance in the sensor signal SS indicative of a qualifying pressure change incident on the speaker 220, distinguishing (step S8) the type of qualifying disturbance and thus the type of qualifying pressure change detected, and controlling (step S10) the host device in response to the detection depending on which type of qualifying disturbance has been detected. Such control may comprise entering a high-power mode of operation from a low-power mode of operation, or vice versa, dependent on which type of qualifying disturbance has been detected. The method 700 may then return to step S6 and continue to cycle through until, for example, the host device is powered down.

Figure 17C:
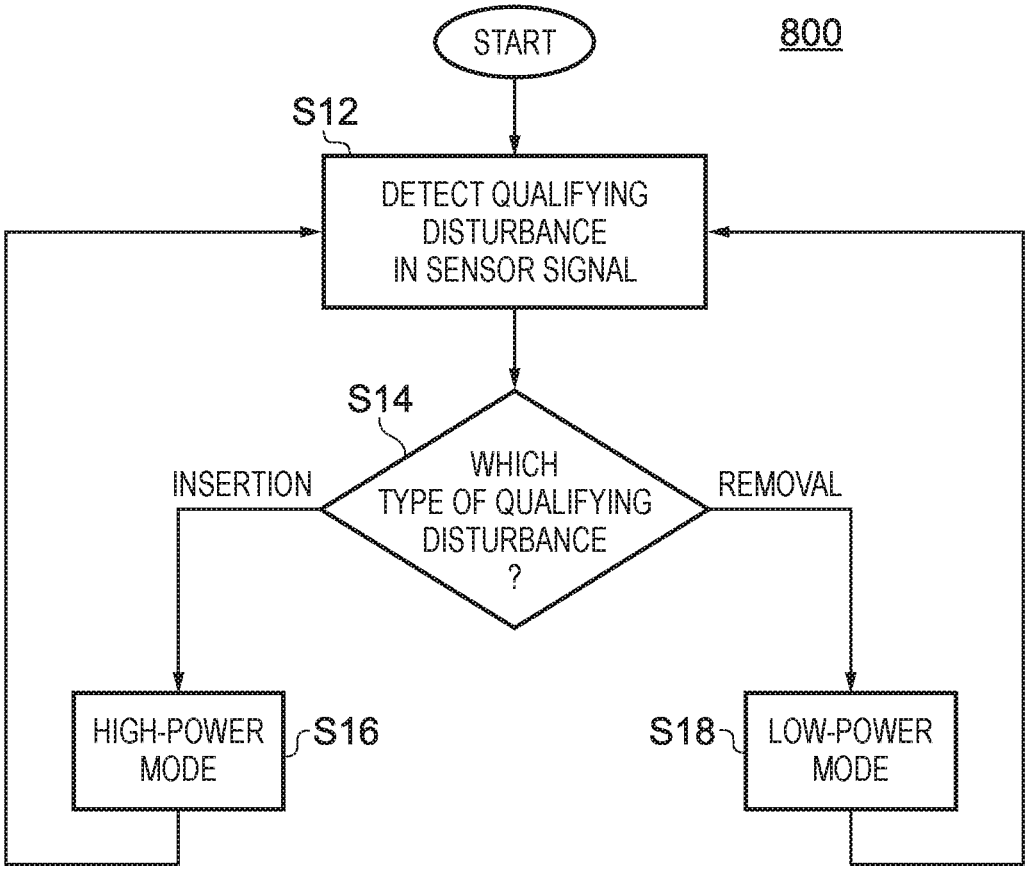

FIG. 17C is a schematic diagram of a method 800 which may be carried out by the host device 100 or 500, for example by the controller and/or audio circuitry thereof, in a case where the host device is an in-ear headphone. The method comprises, detecting (step S12) a qualifying disturbance in the sensor signal SS indicative of a qualifying pressure change incident on the speaker 220, and distinguishing (step S14) the type of qualifying disturbance and thus the type of qualifying pressure change detected, where the types relate to an insertion event and a removal event, respectively. If an insertion event is detected, the method proceeds to step S16 and the host device is controlled to enter or continue operating in a high-power mode. If a removal event is detected, the method proceeds to step S18 and the host device is controlled to enter or continue operating in a low-power mode. The method 800 may then return, from step S16 or step S18, to step S12 and continue to cycle through until, for example, the host device is powered down.

Figure 17D:
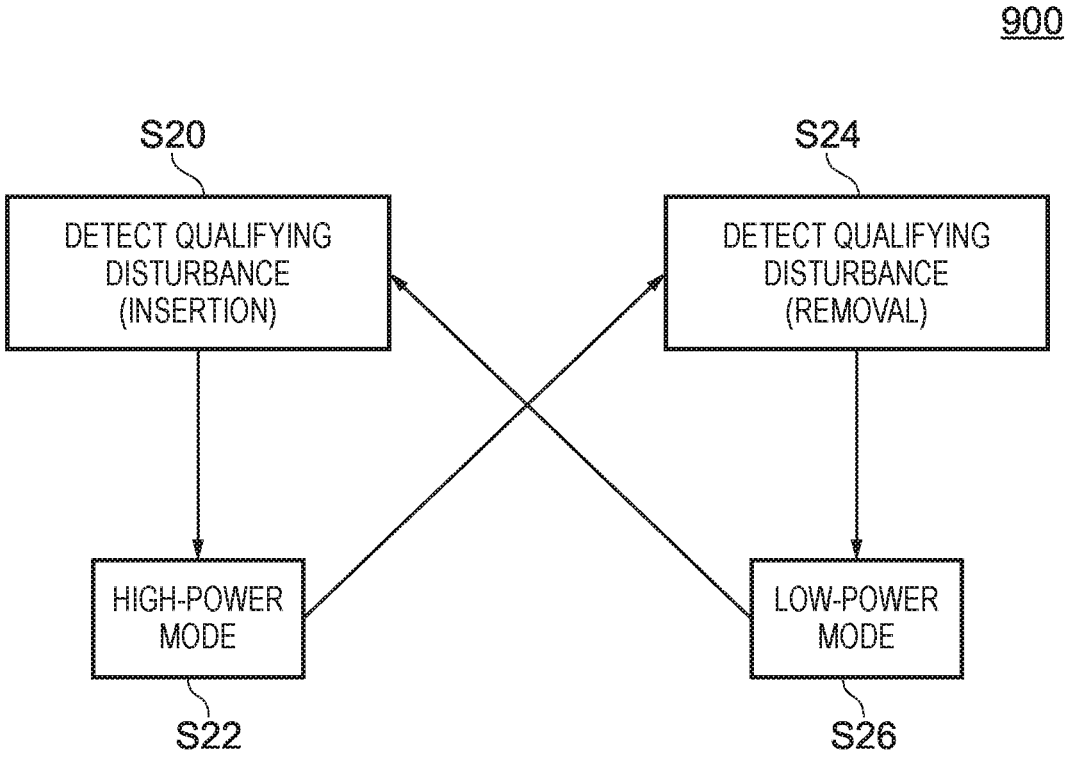

FIG. 17D is a schematic diagram of a method 900 which may be carried out by the host device 100 or 500, for example by the controller and/or audio circuitry thereof, in a case where the host device is an in-ear headphone.

The method comprises, detecting (step S20) a qualifying disturbance in the sensor signal SS indicative of a qualifying pressure change incident on the speaker 220 which corresponds to an insertion event, and, if an insertion event is detected, controlling the host (S22) to enter or continue operating in a high-power mode. Once in the high-power mode, the method comprises detecting (step S24) a qualifying disturbance in the sensor signal SS indicative of a qualifying pressure change incident on the speaker 220 which corresponds to a removal event, and, if a removal event is detected, controlling the host (S26) to enter or continue operating in a low-power mode. Once in the low-power mode, the method returns to step S20.

It may be that the event detector 400 operates in a different way in step S20 from in step S24, for example given that the host device may be in the low-power mode in step S20 and in the high-power mode in step S24. For example, the event detector may operate in accordance with implementation 400B or 400C in step S24 and in accordance with implementation 400D or 400E in step S24. Operation of a neural network in line with implementation 400B may consume more power than operation of a peak/spike detector based on an analogue voltage signal MO(V) in line with implementation 400D or 400E.

The method 900 may start at any of its steps and continue to cycle through until, for example, the host device is powered down.

As mentioned earlier, the detection of voice commands or ear biometrics may form a secondary part of detecting whether the host device 100 should be "woken up" from a low-power state, or conversely entered into a "sleep mode".

For example, the detection of an insertion event (off-ear to on-ear state transition) or a removal event (on-ear to off-ear state transition) by (only) detecting a shift in steady-state ambient pressure incident on the speaker may allow that detection to have a certain confidence level. By performing a secondary detection, such as detection of ear biometrics, in response to the detection of the shift in steady-state ambient pressure, it may be possible to increase that confidence level. This may avoid deciding that the host device should be "woken up" from a low-power state, or conversely entered into a "sleep mode", in a case where in fact an off-ear to on-ear state transition, or an on-ear to off-ear transition, has not occurred.

The secondary (second-stage) detection could be employed to detect the presence of any ear (off-ear to on-ear state transition) or the absence of any ear (on-ear to off-ear transition), i.e. without regard to whose ear it is. Such secondary detection could be followed by tertiary (third-stage) detection of the presence of a particular user's ear (off-ear to on-ear state transition) or the absence of a particular user's ear (on-ear to off-ear transition), i.e. with the added sophistication of determining whose ear it is.

The decision as to whether the host device should be "woken up" (e.g. partially, or in stages) from a low-power state, or conversely entered into a "sleep mode" (e.g. partially, or in stages), may then be dependent on the secondary and/or tertiary detection. The tertiary detection may be considered part of the secondary detection.

Figure 18:
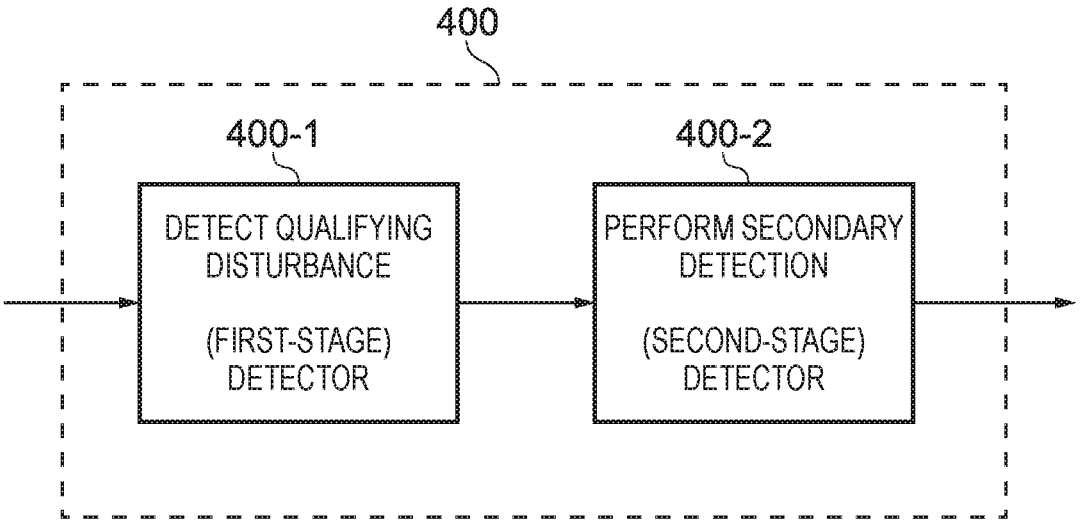
FIG. 18 is a schematic diagram an event detector according to embodiments of the disclosure.

With this in mind, and looking back to FIG. 3, the event detector 400 may be considered to comprise a first-stage detector 400-1 operable to perform the detection of a qualifying disturbance in the sensor signal as described earlier (see FIG. 8), and a second-stage detector 400-2 operable, in response to the detection of a qualifying disturbance by the first-stage detector 400-1, to perform a second-stage detection to determine (with greater confidence) if the detected qualifying disturbance is indicative of a given event. FIG. 18 is a schematic diagram of such an event detector.

For simplicity, the second-stage detector 400-2 may be configured to carry out the second-stage detection and/or the third-stage detection as above, optionally in a sequence with e.g. the third-stage detection dependent on the second-stage detection. That is, the second-stage detector 400-2 may—in some arrangements—be considered representative of a second-stage detector and a third-stage detector in combination.

In terms of a method, the detection of a given event (on-ear transition detection) may comprise a first-stage detection (detection of a qualifying disturbance in the sensor signal SS, as described earlier), followed by at least a second-stage detection if the qualifying disturbance is detected. If the second-stage detection is successful, e.g. an ear is detected, a third-stage detection may follow, e.g. to detect an ear of a specific user. The event detection signal EDS may be issued following any of these detections. These detections could be performed in parallel, in which case the event detection signal EDS may be issued dependent on the result of any one of, or any combination of, these detections.

As above, the host device 100 may have a range of different power levels. For example, in relation to an insertion event, the host device 100 may transition from a lowest power "sleep" mode to a medium power "partially woken" mode on detecting a shift in steady-state ambient pressure, and then carry out the secondary (second-stage) detection in that "partially woken" mode, for example because the secondary detection may have higher power requirements than the detection of a shift in steady-state ambient pressure. In this way, energy may be conserved and power only increased to the extent needed.

That is, the first-stage detection (of a shift in steady-state ambient pressure) may effectively be used as a power-gating method of not continuing with the second-stage detection unless desirable—i.e. success in the first-stage detection triggers the second-stage detection. If the second-stage detection is successful (e.g. detecting the presence of any ear using ear biometrics), then the host device 100 may transition from the medium power "partially woken" mode to a higher power "fully woken" or "more fully woken" mode. There may even be power-gating here before proceeding with a third-stage detection of a specific ear—i.e. success in the second-stage detection triggers the third-stage detection. The following description will focus on "sleep" and "woken" modes for simplicity, however it will be borne in mind that a range of different power levels may be employed.

As an example implementation of the second-stage and/or third-stage detection, biometric authentication will be considered.

As described above, biometric authentication in general involves the comparison of a biometric input signal (in particular, one or more features extracted from that input signal) to a stored template for an authorised user. Any of the signals MO, MI and SS described above could serve as the input signal. The stored template is typically acquired during an "enrolment" process, as described above. Some biometric authentication processes may also involve the comparison of the biometric input signal (or features extracted therefrom) to a "universal model" descriptive of the biometrics of the population at large, as opposed to the specific authorised user.

An output of the biometric authentication process is a score, indicative of the likelihood that the biometric input signals are those of the authorised user. For example, a relatively high score may be indicative of a relatively high likelihood that the biometric input signals match the authorised user; a relatively low score may be indicative of a relatively low likelihood that the biometric input signals match the authorised user. Biometric processors may make a decision on whether to authenticate a particular user as an authorised user or not by comparing the biometric score to a threshold value. For example, if the biometric score exceeds the threshold, the user may be authenticated; if the biometric score falls below the threshold, the user may not be authenticated. The value of the threshold may be constant, or may vary (e.g. as a function of the required level of security). The event detector 400 may be considered to comprise such a biometric processor.

Figure 19:
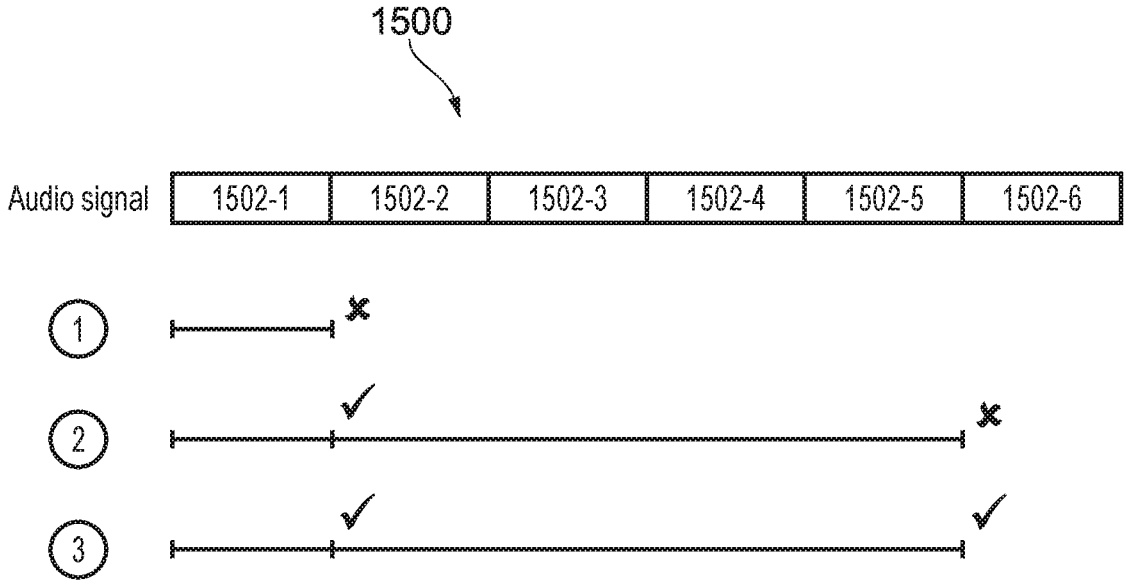
FIG. 19 shows acquisition of an audio signal according to embodiments of the disclosure.

FIG. 19 is a schematic diagram showing one example of the acquisition and use of an audio signal 1500 for the purposes of in-ear detection and ear biometric authentication according to embodiments of the disclosure. Further detail can be found in US 2019/0294769 A1, the entire contents of which are incorporated herein by reference.

Audio signals (as an example input signal) acquired by personal audio devices (host devices) described herein may have inherently low signal-to-noise ratios, owing to the relatively low amplitude of ear biometric features. In order to distinguish reliably between an ear of an authorised user and an ear of an unauthorised user, a biometric algorithm may require a relatively large amount of data. This is because the ear biometric features have relatively low amplitude, but also because ear biometrics vary only slightly between different individuals.

In contrast, the differences are more significant between biometric input signals which are indicative of the presence of any ear and biometric input signals which are indicative of the absence of any ear. Thus, systems and methods according to embodiments of the disclosure may be able to discriminate reliably between the presence and absence of any ear based on relatively little data. In other words, in-ear (on-ear) detection according to embodiments of the disclosure can be performed quickly and consuming relatively little power.

In a practical system, it is envisaged that a decision on the presence or absence of any ear may be taken reliably based on 5-10 data frames, whereas a decision on the presence of a particular ear (e.g., that of an authorised user) may be taken reliably based on approximately 100 data frames. This concept is illustrated in FIG. 19, where an input audio signal 1500 comprises a train of data frames 1502-*n* (where n is an integer). Each data frame may comprise one or more data samples.

Three different scenarios are illustrated. In each case, a biometric algorithm is performed based on the audio signal, involving the comparison of biometric features extracted from the audio signal 1500 to a template or ear print for an authorised user, and the generation of a biometric score indicating the likelihood that the ear of an authorised user is present. The biometric score may be based on the accumulated data in the audio signal 500, and thus may evolve and converge over time towards a "true" value. The biometric algorithm may comprise one or more different types of ear biometric features, in the latter case fusing the ear biometric scores or decisions as described above.

In the illustrated embodiment, the biometric module first determines whether the audio signal 500 comprises ear biometric features which are indicative of the presence of any ear. The determination may be based on relatively little data. In the illustrated example, the biometric module 416 makes the determination based on a single data frame; however, any number of data frames may be used to make the determination. The determination may involve the comparison of the current biometric score to a threshold $T_1$.

In scenario 1, the biometric module 416 determines that no ear is present, and thus the biometric algorithm ends without further calculations after data frame 502-1. This may be considered a second-stage detection as mentioned above. In particular, the biometric module 416 does not go on to determine whether the audio signal 500 comprises ear biometric features which correspond to those of an authorised user. Of course, the algorithm may be repeated in future, e.g., periodically or in response to detection of some event.

In scenario 2, the biometric module 416 determines after data frame 502-1 that an ear is present (second-stage detection) and, responsive to that determination, goes on to perform a "full" biometric algorithm (third-stage detection) in order to determine whether the ear belongs to an authorised user or not. This process may require relatively more data, and thus in the illustrated embodiment an authentication decision can only be reliably taken after data frame 502-5. In scenario 2, this determination is negative (i.e. the user is not authorised). Scenario 3 corresponds substantially to scenario 2, but the authentication device is positive (i.e. the user is authorised). In either case, the data on which the authentication decision is taken may comprise more data frames than the data on which the in-ear (on-ear) detect decision is taken. For example, the data may be averaged across all data frames. The determination may involve the comparison of the current biometric score to a threshold T2.

Thus the present disclosure provides methods, apparatus and systems for performing in-ear detection using a biometric processor or module.

Another example implementation of the second-stage and/or third-stage detection, biometric authentication can be understood from U.S. Pat. No. 6,697,299, the entire contents of which are incorporated herein by reference. Reference is made specifically to FIGS. 5 and 6 of that document.

In this example, the electrical impedance of the loudspeaker (of the speaker unit) 220 is measured over a range of frequencies (e.g. when sounds from 100 Hz to 500 Hz in frequency are sent form the loudspeaker), e.g. while the host device 100 is in an on-ear state. Obtained impedances are then plotted on coordinates with real numbers on one of the axes and imaginary numbers on the other one of the axes.

Such plots of electrical impedances are found to be different from person to person, i.e based on differing characteristics of peoples ears. In the range from 100 HZ to 500 Hz, lower frequencies make the differences more conspicuous, indicating that the use of low-frequency regions is suitable for individual authentication.

Electrical impedances may be obtained by measuring circuit (e.g. speaker) voltages and currents (using the monitoring units described above), and may be represented by the absolute values and phases of the impedances. As with the example above in connection with FIG. 19, the plots for any ear vs. no ear are more readily distinguishable than the plots for one ear vs. another. Thus, similar considerations apply regarding making an initial detection of any ear and then potentially detecting a specific ear (if desired).

As another example implementation of the second-stage and/or third-stage detection, the second-stage/third-stage detection could involve detecting a qualifying disturbance in the sensor signal SS as described earlier but in a different way from the first-stage detection. The second-stage/third-stage detection could even involve detecting a qualifying disturbance in the sensor signal SS as described earlier and using the same method as the first-stage detection. Both of these approaches could be considered a form of "double checking". In these cases, the second-stage/third-stage detection could be performed on the same data as the first-stage detection, e.g. a snapshot or (time-based) segment or portion of the sensor signal SS.

Taking an example where the second-stage/third-stage detection involves detecting a qualifying disturbance in the sensor signal SS but in a different way from the first-stage detection, the first-stage detection could involve detection using the detector 400A (spike or peak or ringing detector) of FIG. 11 and the second-stage detection could involve detection using the detector 400B (neural network or classifier) of FIG. 12. In this example the power requirements may be greater for the first-stage detection than the second-stage detection, and thus it may be appropriate to "power-gate" the second-stage detection based on the results of the first-stage detection (i.e. trigger the second-stage detection (only) if the first-stage detection is successful). Of course, it may be possible to perform any number of different/same detections of a qualifying disturbance in a sequence and/or in parallel.

Embodiments of the disclosure may be implemented in an electronic, portable and/or battery powered host device such as a smartphone, an audio player, a mobile or cellular phone, a handset. Embodiments may be implemented on one or more integrated circuits provided within such a host device. Embodiments may be implemented in a personal audio device configurable to provide audio playback to a single person, such as a smartphone, a mobile or cellular phone, headphones, earphones, etc. See FIGS. 1*a* to 1*e*. Again, embodiments may be implemented on one or more integrated circuits provided within such a personal audio device. In yet further alternatives, embodiments may be implemented in a combination of a host device and a personal audio device. For example, embodiments may be implemented in one or more integrated circuits provided within the personal audio device, and one or more integrated circuits provided within the host device.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments and implementations likewise, with the benefit of this disclosure, will be apparent to those having ordinary skill in the art, and such embodiments should be deemed as being encompassed herein. Further, those having ordinary skill in the art will recognize that various equivalent techniques may be applied in lieu of, or in conjunction with, the discussed embodiments, and all such equivalents should be deemed as being encompassed by the present disclosure.

The skilled person will recognise that some aspects of the above described apparatus (circuitry) and methods may be embodied as processor control code (e.g. a computer program), for example on a non-volatile carrier medium such as a disk, CD- or DVD-ROM, programmed memory such as read only memory (Firmware), or on a data carrier such as an optical or electrical signal carrier. For example, the microphone signal generator 240 (and its sub-units 250, 260) may be implemented as a processor operating based on processor control code. As another example, the controllers 102, 502A, 502B may be implemented as a processor operating based on processor control code. As another example, the event detector may in some instances be implemented as a processor operating based on processor control code (for example, when implementing a neural network or classifier).

For some applications, such aspects will be implemented on a DSP (Digital Signal Processor), ASIC (Application Specific Integrated Circuit) or FPGA (Field Programmable Gate Array). Thus the code may comprise conventional program code or microcode or, for example, code for setting up or controlling an ASIC or FPGA. The code may also comprise code for dynamically configuring re-configurable apparatus such as re-programmable logic gate arrays. Similarly, the code may comprise code for a hardware description language such as Verilog™ or VHDL. As the skilled person will appreciate, the code may be distributed between a plurality of coupled components in communication with one another. Where appropriate, such aspects may also be implemented using code running on a field-(re)programmable analogue array or similar device in order to configure analogue hardware.

Some embodiments of the present invention may be arranged as part of an audio processing circuit, for instance an audio circuit (such as a codec or the like) which may be provided in a host device as discussed above. A circuit or circuitry according to an embodiment of the present invention may be implemented (at least in part) as an integrated circuit (IC), for example on an IC chip. One or more input or output transducers (such as speaker 220) may be connected to the integrated circuit in use.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in the claim, "a" or "an" does not exclude a plurality, and a single feature or other unit may fulfil the functions of several units recited in the claims. Any reference numerals or labels in the claims shall not be construed so as to limit their scope.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

The present disclosure extends to the following statements.

S1. Audio circuitry, comprising:

a monitoring unit operable to monitor a speaker current flowing through a speaker and/or a speaker voltage induced across the speaker, and to generate a monitor signal indicative of the speaker current and/or the speaker voltage; and an event detector operable to detect a qualifying disturbance in a sensor signal indicative of a qualifying pressure change incident on the speaker, wherein the sensor signal is, or is derived from, the monitor signal.

S2. The audio circuitry according to statement S1, wherein:

the audio circuitry is or comprises on-ear transition detection circuitry;

each qualifying pressure change comprises a shift in steady-state, running average or baseline ambient pressure incident on the speaker; and/or each qualifying pressure change comprises a change in steady state value of the ambient pressure incident on the speaker; and/or each qualifying pressure change is a qualifying steady-state pressure change; and/or each qualifying pressure change is a pressure change caused by the speaker transitioning from an on-ear state to an off-ear state or vice versa; and/or for each qualifying pressure change, the corresponding qualifying disturbance comprises or is a change, step response, spike or ringing in the sensor signal.

S3. The audio circuitry according to statement S2, wherein:

each said shift comprises a step change; and/or each said qualifying disturbance is temporary or substantially time-limited; and/or each said qualifying disturbance is responsive to or resultant from a corresponding qualifying pressure change; and/or each said qualifying disturbance satisfies a given or stored or predetermined qualifying definition or specification.

S4. The audio circuitry according to any of the preceding statements, wherein the event detector is operable, in order to detect each qualifying disturbance indicative of a corresponding qualifying pressure change, to compare the sensor signal to a corresponding qualifying specification which defines that qualifying disturbance (and determine that a candidate disturbance in the sensor signal is that qualifying disturbance if that candidate disturbance satisfies that qualifying specification).

S5. The audio circuitry according to statement S4, wherein each qualifying specification comprises at least one of:

a definition of a qualifying criterion or of qualifying criteria;

a configuration for a neural network or classifier implemented by the event detector; and a threshold value, such as a magnitude value, a rate of change value, an average value, a running average value, a peak magnitude, a rise or fall time, a time constant, a settling time, and/or a frequency response value.

S6. The audio circuitry according to any of the preceding statements, wherein the event detector comprises:

a controller configured as neural network or classifier and operable, based on the sensor signal, to detect a qualifying disturbance in the sensor signal; and/or a peak detector configured to detect a qualifying peak in the sensor signal; and/or a spike detector configured to detect a qualifying spike in the sensor signal.

S7. The audio circuitry according to any of the preceding statements, wherein the event detector is operable, based on the sensor signal, to detect a plurality of different qualifying disturbances which correspond respectively to a plurality of different qualifying pressure changes.

S8. The audio circuitry according to statement S7, wherein:

said plurality of different qualifying disturbances comprises a first qualifying disturbance and a second qualifying disturbance which correspond respectively to first and second qualifying pressure changes;

the first and second qualifying pressure changes are substantially opposite from one another in polarity so that the first and second disturbances in the sensor signal are also substantially opposite from one another in polarity; and the event detector is configured to distinguish between the first and second qualifying pressure changes at least partly by detecting the polarity of the disturbance concerned detected in the sensor signal, optionally wherein the first qualifying pressure change corresponds to the transition of the speaker from the on-ear state to the off-ear state and the second qualifying pressure change corresponds to the transition of the speaker from the off-ear state to the on-ear state.

S9. The audio circuitry according to any of the preceding statements, further comprising a speaker driver operable to drive the speaker based on a speaker signal, wherein:

the event detector comprises a microphone signal generator;

the microphone signal generator is operable, when a candidate pressure change is incident on the speaker, to generate a microphone signal representative of the candidate pressure change based on the monitor signal and the speaker signal; and the sensor signal is or is derived from the microphone signal.

S10. The audio circuitry according to statement S9, wherein the event detector is operable to detect when the candidate pressure change is or comprises a qualifying pressure change based on the sensor signal.

S11. The audio circuitry according to statement S9 or S10, wherein the candidate pressure change comprises external sound incident on the speaker.

S12. The audio circuitry according to any of statements S9 to S11, wherein the microphone signal generator comprises a converter configured to convert the monitor signal into the microphone signal based on the speaker signal, the converter defined at least in part by a transfer function modelling at least the speaker.

S13. The audio circuitry according to statement S12, wherein the transfer function further models at least one of the speaker driver and the monitoring unit, or both of the speaker driver and the monitoring unit.

S14. The audio circuitry according to statement S12 or S13, wherein:

the speaker driver is operable, when the speaker signal is an emit speaker signal, to drive the speaker so that it emits a corresponding sound signal;

when the candidate pressure change is incident on the speaker whilst the speaker signal is an emit speaker signal, the monitor signal comprises a speaker component resulting from the speaker signal and a microphone component resulting from the candidate pressure change; and the converter is defined such that, when the candidate pressure change is incident on the speaker whilst the speaker signal is an emit speaker signal, it filters out the speaker component and/or equalises and/or isolates the microphone component when converting the monitor signal into the microphone signal.

S15. The audio circuitry according to any of statements S12 to S14, wherein:

the speaker driver is operable, when the speaker signal is a non-emit speaker signal, to drive the speaker so that it substantially does not emit a sound signal;

when the candidate pressure change is incident on the speaker whilst the speaker signal is a non-emit speaker signal, the monitor signal comprises a microphone component resulting from the candidate pressure change; and the converter is defined such that, when the candidate pressure change is incident on the speaker whilst the speaker signal is a non-emit speaker signal, it equalises and/or isolates the microphone component when converting the monitor signal into the microphone signal.

S16. The audio circuitry according to any of statements S12 to S15, wherein the microphone signal generator is configured to determine or update the transfer function or parameters of the transfer function based on the monitor signal and the speaker signal when the speaker signal is an emit speaker signal which drives the speaker so that it emits a corresponding sound signal.

S17. The audio circuitry according to any of statements S12 to S16, wherein the microphone signal generator is configured to determine or update the transfer function or parameters of the transfer function based on the microphone signal.

S18. The audio circuitry according to statement S16 or S17, wherein the microphone signal generator is configured to redefine the converter as the transfer function or parameters of the transfer function change.

S19. The audio circuitry according to any of statements S12 to S18, wherein the converter is configured to perform conversion so that the microphone signal is output as a sound pressure level signal.

S20. The audio circuitry according to any of statements S12 to S19, wherein the transfer function and/or the converter is defined at least in part by Thiele-Small parameters.

S21. The audio circuitry according to any of the preceding statements, wherein:

the speaker signal is indicative of or related to or proportional to a voltage signal applied to the speaker; and/or the monitor signal is related to or proportional to the speaker current flowing through the speaker; and/or the monitor signal is related to or proportional to a voltage signal induced across the speaker.

S22. The audio circuitry according to statement S21, wherein the speaker driver is operable to control the voltage signal applied to the speaker so as to maintain or tend to maintain a given relationship between the speaker signal and the applied voltage signal.

S23. The audio circuitry according to any of the preceding statements, wherein the monitoring unit comprises an impedance connected such that said speaker current flows through the impedance, and wherein the monitor signal is generated based on a voltage across the impedance, optionally wherein the impedance is a resistor.

S24. The audio circuitry according to any of the preceding statements, wherein the monitoring unit comprises a current-mirror arrangement of transistors connected to mirror said speaker current to generate a mirror current, and wherein the monitor signal is generated based on the mirror current.

S25. The audio circuitry according to any of the preceding statements, comprising the speaker.

S26. The audio circuitry according to any of the preceding statements, comprising a speaker-signal generator operable to generate said speaker signal and/or a microphone-signal analyser operable to analyse the microphone signal.

S27. The audio circuitry according to any of the preceding statements, wherein the event detector is operable, in response to the detection of a qualifying disturbance, to generate an event detection signal indicative of the corresponding qualifying pressure change.

S28. The audio circuitry according to any of the preceding statements, wherein the event detector comprises:

a first-stage detector operable to perform said detection of a qualifying disturbance in the sensor signal; and a second-stage detector operable, (only) in response to the detection of a qualifying disturbance by the first-stage detector, to perform a second-stage detection to determine if the detected qualifying disturbance is indicative of a given event, wherein the second-stage detector is operable to generate an event detection signal indicative of the given event dependent on a result of the second-stage detection.

S29. The audio circuitry according to statement S27 or S28, comprising an event controller operable to analyse the event detection signal and to output a control signal dependent on the analysis.

The event detection signal may be used to control the power level of the host device, e.g. between different levels of power usage (e.g. any of sleep mode, woken mode, low power mode, medium power mode, high power mode, woken mode, etc.).

The audio circuitry may be referred to as transducer circuitry (e.g. if the speaker is replaced with a transducer not necessarily being a speaker). Examples of transducers that could detect a pressure differential could be any capacitive-based transducer or coil-based transducer, e.g. an accelerometer. References to the speaker could be replaced with references to an accelerometer or a microphone or a pressure/force sensor for example. The audio circuitry may be referred to as on-ear transition detection circuitry (e.g. if the qualifying pressure change incident on the speaker is caused by the speaker transitioning from an on-ear state to an off-ear state or vice versa).

S30. The audio circuitry according to any of the preceding statements, comprising an analogue-to-digital converter configured to output the monitor signal and/or the sensor signal as a digital signal based on the speaker current and/or the speaker voltage.

S31. An audio processing system, comprising:

the audio circuitry according to any of the preceding statements; and a processor configured to control operation of the audio processing system based on the detection.

S32. The audio processing system according to statement S31, wherein the processor is configured to:

transition from a low-power state to a higher-power state in response to the detection; and/or transition from a high-power state to a lower-power state in response to the detection.

S33. A host device, comprising the audio circuitry according to any of statements 1 to 29 or the audio processing system according to statement S31 or S32.

S34. The host device according to statement S33, being a headphone such as an in-ear headphone and comprising the speaker.

S34. Transducer circuitry, comprising:

a monitoring unit operable to monitor a transducer current flowing through a transducer and/or a transducer voltage induced across the transducer, and to generate a monitor signal indicative of the transducer current and/or the transducer voltage; and an event detector operable to detect a qualifying disturbance in a sensor signal indicative of a qualifying pressure change incident on the transducer, wherein the sensor signal is, or is derived from, the monitor signal.

S35. A method of detecting a qualifying pressure change incident on a speaker, the method comprising:

generating a monitor signal indicative of a speaker current flowing through the speaker and/or a speaker voltage induced across the speaker; and detecting a qualifying disturbance in a sensor signal indicative of a qualifying pressure change incident on the speaker, wherein the sensor signal is, or is derived from, the monitor signal.

S36. A method of detecting the insertion into or removal from an ear canal of an in-ear headphone, the in-ear headphone comprising a speaker, the method comprising:

generating a monitor signal indicative of a speaker current flowing through the speaker and/or a speaker voltage induced across the speaker; and detecting a qualifying disturbance in a sensor signal indicative of a qualifying pressure change incident on the speaker, wherein the sensor signal is, or is derived from, the monitor signal, and wherein the qualifying pressure change corresponds to the insertion into or removal from the ear canal of the in-ear headphone.

S37. A method of detecting the insertion into or removal from an ear canal of an in-ear headphone, the in-ear headphone comprising a speaker, the method comprising:

generating a monitor signal indicative of a speaker current flowing through the speaker and/or a speaker voltage induced across the speaker; and detecting a disturbance in a sensor signal indicative of the insertion into or removal from the ear canal of the in-ear headphone, wherein the sensor signal is, or is derived from, the monitor signal.

S38. A method of detecting a transition of a speaker from an on-ear state to an off-ear state or vice versa, the method comprising:

generating a monitor signal indicative of a speaker current flowing through the speaker and/or a speaker voltage induced across the speaker; and detecting a disturbance in a sensor signal indicative of the transitioning, wherein the sensor signal is, or is derived from, the monitor signal.

The invention claimed is:

1. On-ear transition detection circuitry, comprising:

a monitoring unit operable to monitor a speaker current flowing through a speaker and/or a speaker voltage induced across the speaker, and to generate a monitor signal indicative of the speaker current and/or the speaker voltage; and an event detector operable to detect a qualifying disturbance in a sensor signal indicative of a qualifying pressure change incident on the speaker caused by the speaker transitioning from an on-ear state to an off-ear state or vice versa, wherein the sensor signal is, or is derived from, the monitor signal;

wherein:

the event detector is operable, based on the sensor signal, to detect a plurality of different qualifying disturbances which correspond respectively to a plurality of different qualifying pressure changes;

said plurality of different qualifying disturbances comprises a first qualifying disturbance and a second qualifying disturbance which correspond respectively to first and second qualifying pressure changes;

the first and second qualifying pressure changes are substantially opposite from one another in polarity so that the first and second disturbances in the sensor signal are also substantially opposite from one another in polarity; and the event detector is configured to distinguish between the first and second qualifying pressure changes at least partly by detecting the polarity of the disturbance concerned detected in the sensor signal.

2. The on-ear transition detection circuitry as claimed in claim 1, wherein:

each qualifying pressure change comprises a shift or change in steady-state ambient pressure incident on the speaker; and/or for each qualifying pressure change, the corresponding qualifying disturbance comprises a step response or ringing in the sensor signal.

3. The on-ear transition detection circuitry as claimed in claim 2, wherein each said qualifying disturbance satisfies a given or stored or predetermined qualifying definition or specification.

4. The on-ear transition detection circuitry as claimed claim 1, wherein the event detector is operable, in order to detect each qualifying disturbance indicative of a corresponding qualifying pressure change, to:

compare the sensor signal to a corresponding qualifying specification which defines that qualifying disturbance; and determine that a candidate disturbance in the sensor signal is that qualifying disturbance if that candidate disturbance satisfies that qualifying specification.

5. The on-ear transition detection circuitry as claimed in claim 4, wherein each qualifying specification comprises at least one of:

a definition of a qualifying criterion or of qualifying criteria;

a configuration for a neural network or classifier implemented by the event detector; and a threshold value, such as a magnitude value, a rate of change value, an average value, a running average value, a peak magnitude, a rise or fall time, a time constant, a settling time, and/or a frequency response value.

6. The on-ear transition detection circuitry as claimed in claim 1, wherein the event detector comprises:

a controller configured as neural network or classifier and operable, based on the sensor signal, to detect a qualifying disturbance in the sensor signal; and/or a peak detector configured to detect a qualifying peak in the sensor signal; and/or a spike detector configured to detect a qualifying spike in the sensor signal.

7. The on-ear transition detection circuitry as claimed in claim 1, wherein:

the first qualifying pressure change corresponds to the transition of the speaker from the on-ear state to the off-ear state and the second qualifying pressure change corresponds to the transition of the speaker from the off-ear state to the on-ear state.

8. The on-ear transition detection circuitry as claimed in claim 1, further comprising a speaker driver operable to drive the speaker based on a speaker signal, wherein:

the event detector comprises a microphone signal generator;

the microphone signal generator is operable, when a candidate pressure change is incident on the speaker, to generate a microphone signal representative of the candidate pressure change based on the monitor signal and the speaker signal; and the sensor signal is the microphone signal or is derived from the microphone signal.

9. The on-ear transition detection circuitry as claimed in claim 8, wherein the event detector is operable to detect when the candidate pressure change is or comprises a qualifying pressure change based on the sensor signal.

10. The on-ear transition detection circuitry as claimed in claim 8, comprising a speaker-signal generator operable to generate said speaker signal and/or a microphone-signal analyser operable to analyse the microphone signal.

11. The on-ear transition detection circuitry as claimed in claim 1, comprising the speaker.

12. The on-ear transition detection circuitry as claimed in claim 1, wherein the event detector is operable, in response to the detection of a qualifying disturbance, to generate an event detection signal indicative of the corresponding qualifying pressure change.

13. The on-ear transition detection circuitry as claimed in claim 12, comprising an event controller operable to analyse the event detection signal and to output a control signal dependent on the analysis.

14. The on-ear transition detection circuitry as claimed in claim 1, wherein the event detector comprises:

a first-stage detector operable to perform said detection of a qualifying disturbance in the sensor signal; and a second-stage detector operable, in response to the detection of a qualifying disturbance by the first-stage detector, to perform a second-stage detection to determine if the detected qualifying disturbance is indicative of a given event, wherein the second-stage detector is operable to generate an event detection signal indicative of the given event dependent on a result of the second-stage detection.

15. The on-ear transition detection circuitry as claimed in claim 1, comprising an analogue-to-digital converter configured to output the monitor signal and/or the sensor signal as a digital signal based on the speaker current and/or the speaker voltage.

16. An audio processing system, comprising:

the on-ear transition detection circuitry as claimed in claim 1; and a processor configured to control operation of the audio processing system based on the detection.

17. The audio processing system as claimed in claim 16, wherein the processor is configured to:

transition from a lower-power state to a higher-power state in response to the detection; and/or transition from a higher-power state to a lower-power state in response to the detection.

18. A host device, comprising the on-ear transition detection circuitry as claimed in claim 1 optionally being a headphone such as an in-ear headphone and comprising the speaker.

19. A method of detecting a transition of a speaker from an on-ear state to an off-ear state or vice versa, the method comprising:

generating a monitor signal indicative of a speaker current flowing through the speaker and/or a speaker voltage induced across the speaker; and detecting a disturbance in a sensor signal indicative of the transitioning, wherein the sensor signal is, or is derived from, the monitor signal;

wherein:

the method comprises, based on the sensor signal, detecting a plurality of different qualifying disturbances which correspond respectively to a plurality of different qualifying pressure changes;

said plurality of different qualifying disturbances comprises a first qualifying disturbance and a second qualifying disturbance which correspond respectively to first and second qualifying pressure changes;

the first and second qualifying pressure changes are substantially opposite from one another in polarity so that the first and second disturbances in the sensor signal are also substantially opposite from one another in polarity; and the method comprises distinguishing between the first and second qualifying pressure changes at least partly by detecting the polarity of the disturbance concerned detected in the sensor signal.

* * * * *